US012227929B2

(12) United States Patent
Jensen

(10) Patent No.: US 12,227,929 B2
(45) Date of Patent: Feb. 18, 2025

(54) SIPHON FLUSH VALVE AND TOILET ASSEMBLY

(71) Applicant: AS America, Inc., Piscataway, NJ (US)

(72) Inventor: Robert M. Jensen, East Brunswick, NJ (US)

(73) Assignee: AS America, Inc., Piscataway, NJ (US)

( * ) Notice: Subject to any disclaimer, the term of this patent is extended or adjusted under 35 U.S.C. 154(b) by 105 days.

(21) Appl. No.: 18/023,023

(22) PCT Filed: Aug. 25, 2021

(86) PCT No.: PCT/US2021/047505
§ 371 (c)(1),
(2) Date: Feb. 24, 2023

(87) PCT Pub. No.: WO2022/046876
PCT Pub. Date: Mar. 3, 2022

(65) Prior Publication Data

US 2023/0323649 A1 Oct. 12, 2023

Related U.S. Application Data

(60) Provisional application No. 63/070,697, filed on Aug. 26, 2020.

(51) Int. Cl.
*E03D 1/26* (2006.01)
*E03D 1/012* (2006.01)
(Continued)

(52) U.S. Cl.
CPC ..... *E03D 1/263* (2013.01); *E03D 1/012* (2013.01); *E03D 1/08* (2013.01); *E03D 11/02* (2013.01)

(58) Field of Classification Search
CPC ..... E03D 1/263; E03D 1/012; E03D 1/08; E03D 11/02; E03D 1/26
(Continued)

(56) References Cited

U.S. PATENT DOCUMENTS 380,854 A 4/1888 Boyle
423,022 A 3/1890 Boyle
(Continued)

OTHER PUBLICATIONS

PCT/US2021/047505 International Search Report, 2 pages, dated Dec. 7, 2021.

*Primary Examiner* — Lori L Baker
(74) *Attorney, Agent, or Firm* — Tyler A. Stevenson; Anna-lisa L. Gallo

(57) ABSTRACT

A toilet assembly, comprising a toilet tank to hold flush water; a flush valve assembly positioned in the toilet tank; a toilet bowl; and a trapway inflow communication with the toilet bowl, wherein, the flush valve assembly comprises a container having an open lower end and a closed upper end; a siphon flush valve positioned in the container upper end; and a conduit positioned in an interior of the container, wherein the container is in flow communication with the toilet tank, the conduit is coupled to the trapway and provides flow communication between the container and the trapway, and the siphon flush valve comprises a tubular core, a head surrounding a top of the core, and a fluid spray initiator coupled to the head, the spray initiator configured to discharge water into the core to induce a siphon flow of surrounding tank water through the core.

20 Claims, 9 Drawing Sheets

(51) Int. Cl.
*E03D 1/08* (2006.01)
*E03D 11/02* (2006.01)

(58) Field of Classification Search
USPC ..... 4/424, 421
See application file for complete search history.

(56) References Cited

U.S. PATENT DOCUMENTS

| | | | | |
|---|---|---|---|---|
| 439,630 | A | 11/1890 | Boyle | |
| 5,142,712 | A | 9/1992 | Hennessy | |
| 7,010,816 | B2 | 3/2006 | Li | |
| 7,159,251 | B2 | 1/2007 | Hennessy | |
| 8,141,179 | B2 | 3/2012 | Hennessy | |
| 8,196,231 | B2 | 6/2012 | Hennessy | |
| 8,266,732 | B1 | 9/2012 | Wang et al. | |
| 8,943,621 | B2 | 2/2015 | Wang | |
| 10,047,510 | B2 | 8/2018 | Cummings et al. | |
| 10,597,859 | B2 | 3/2020 | Hennessy et al. | |
| 12,042,104 | B2 * | 7/2024 | Hung | E03D 9/052 |
| 2002/0112283 | A1 | 8/2002 | Jansen | |
| 2004/0040076 | A1 | 3/2004 | Han et al. | |
| 2006/0041999 | A1 * | 3/2006 | Sanderson | E03D 1/00 4/378 |
| 2010/0299822 | A1 * | 12/2010 | Vargas | E03D 1/263 4/354 |
| 2017/0247871 | A1 * | 8/2017 | Mukerji | E03D 5/10 |
| 2017/0314246 | A1 | 11/2017 | Wagner | |
| 2021/0115651 | A1 | 4/2021 | Jensen | |
| 2021/0140162 | A1 | 5/2021 | Hennessy et al. | |

* cited by examiner

SIPHON FLUSH VALVE AND TOILET ASSEMBLY

The disclosure relates to a flush valve assembly for a toilet, for example where the toilet is capable of providing a high energy flush with reduced flush water volumes.

BACKGROUND

Typically, toilets incorporate three systems that work together to perform the flushing action: a bowl siphon, a flush mechanism, and a refill mechanism. Working in concert, these three systems allow for and complete a flush cycle of a toilet. A tank, usually positioned over the back of the bowl, contains water that is used to initiate siphoning from the bowl to a sewage line, after which fresh water refills the bowl. When an operator desires to flush the toilet, he or she manipulates a flush lever on the outside of the tank, which is connected on the inside of the tank to a movable chain or lever. A movable chain or lever is typically connected to a flapper positioned over a flush valve inlet. Upon operation, a flush lever moves a chain or lever on the tank interior, thereby lifting a flapper to open a flush valve and cause water to flow from the tank and into the bowl initiate a toilet flush cycle.

A flapper is positioned below a tank water level, and may be prone to leaking due to wear and/or exposure to chemicals. Toilet flappers may be a leading cause of leaking or running toilets.

In many toilet designs, water flows directly into the bowl and disperses into a bowl rim. The water releases into the bowl rather quickly, with flow from the tank into the bowl typically lasting approximately 2 to 4 seconds. The water flows from the rim, down a channel within the sides of the bowl and into a large opening at the bottom of the toilet (commonly known as a siphon jet). A siphon jet releases water into an adjoining siphon tube, initiating a siphon action. A siphon action draws water and waste out of the bowl and into the siphon tube. Waste and water continues through the siphon tube and through a trapway and is released into a wastewater line. Once a tank is emptied of its contents during a flush, the flush valve closes, and a floating mechanism which has now dropped in the tank to some residual amount initiates opening of a fill valve. A fill valve provides fresh water to both the tank and the bowl through separate flows. Eventually the tank fills with water to a high enough level to cause the float to rise, shutting off the fill valve. At this point, a flush cycle is complete.

Excessive consumption of potable water remains a dilemma for water agencies, commercial building owners, homeowners, residents and sanitaryware manufacturers. An increasing global population has negatively affected the amount and quality of suitable water. In response to this global dilemma, many local and federal authorities have enacted regulations that reduce the water demand required by toilet flushing operations. In the United States, for instance, government agencies that regulate water usage have gradually reduced the threshold for fresh water use in toilets, from 7 gallons/flush (prior to the 1950s) to 5.5 gallons/flush (by the end of the 1960s) to 3.5 gallons/flush (in the 1980s). The National Energy Policy Act of 1995 now mandates that toilets sold in the United States can only use 1.6 gallons/flush (6 liters/flush). High-efficiency toilets that use 1.28 gallons per flush (gpf) or less can be certified under the EPA's WaterSense program.

Desired are low volume and/or high-efficiency toilets having a higher energy flush and a more powerful siphon.

There is also a need for improved flush valve technology. In particular, there is a need for a reliable flapperless valve for use in a toilet tank.

SUMMARY

According, disclosed is a toilet assembly, the toilet assembly comprising a toilet tank to hold flush water; a flush valve assembly positioned in the toilet tank; a toilet bowl; and a trapway in flow communication with the toilet bowl, wherein, the flush valve assembly comprises a container having an open lower end and a closed upper end; a siphon flush valve positioned in the container upper end; and a conduit positioned in an interior of the container, wherein the container is in flow communication with the toilet tank, the conduit is coupled to the trapway and provides flow communication between the container and the trapway, and the siphon flush valve comprises a tubular core, a head surrounding a top of the core, and a fluid spray initiator coupled to the head, the spray initiator configured to discharge water into the core to induce a siphon flow of surrounding tank water through the core.

Also disclosed is a flush valve assembly, the flush valve assembly comprising a container having an open lower end and a closed upper end; a siphon flush valve positioned in the container upper end; and a conduit positioned in an interior of the container, wherein the container is configured to be in flow communication with a toilet tank, the siphon flush valve comprises a tubular core, a head surrounding a top of the core, and a fluid spray initiator coupled to the head, the spray initiator configured to discharge water into the core to induce a siphon flow of surrounding toilet tank water through the core, and the conduit is configured to couple to a toilet trapway and to provide flow communication between the container and the trapway.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DISCLOSURE

A siphon flush valve may include a core, a head and a spray initiator. A head and core may be concentric and a spray initiator may be positioned at the top of a siphon flush valve. In use, a flush valve may be positioned in a tank with a starting tank water level sufficient to reach the top of the head. To initiate operation of a flush valve, pressurized water initiates a spray into the core creating a pressure differential within the core causing the tank water to rise up in the head and spill over a valve weir into the core. This establishes a siphon flow of water for discharge into the toilet bowl for cleaning the bowl and removing waste. Once full siphon flow is established through the valve, the pressurized water may be turned off. As the tank water discharges, the tank water level goes down to an ending water level generally at the bottom of the head thereby allowing air to enter into the head to break the siphon. A fill valve may be provided and configured to refill the toilet tank to allow subsequent repeat flush cycles. Details of various exemplary implementations of a siphon flush valve are discussed below with reference to the figures.

Figure 1A:
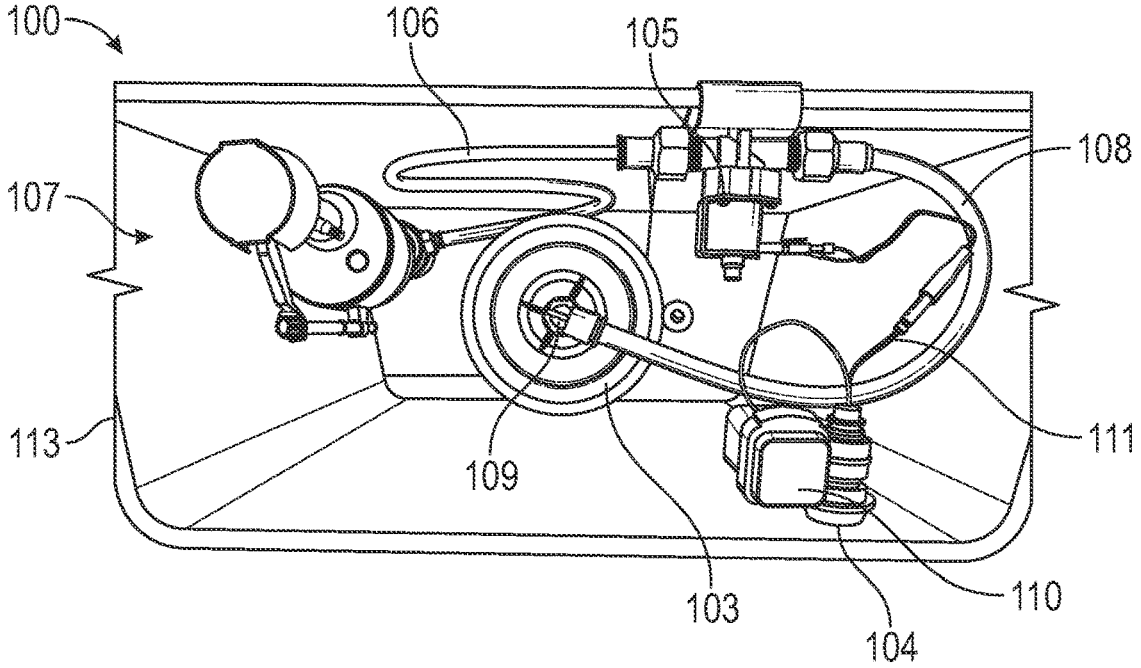
FIG. 1A and FIG. 1B depict a toilet tank assembly comprising a siphon valve assembly, according to an embodiment.
Figure 1B:
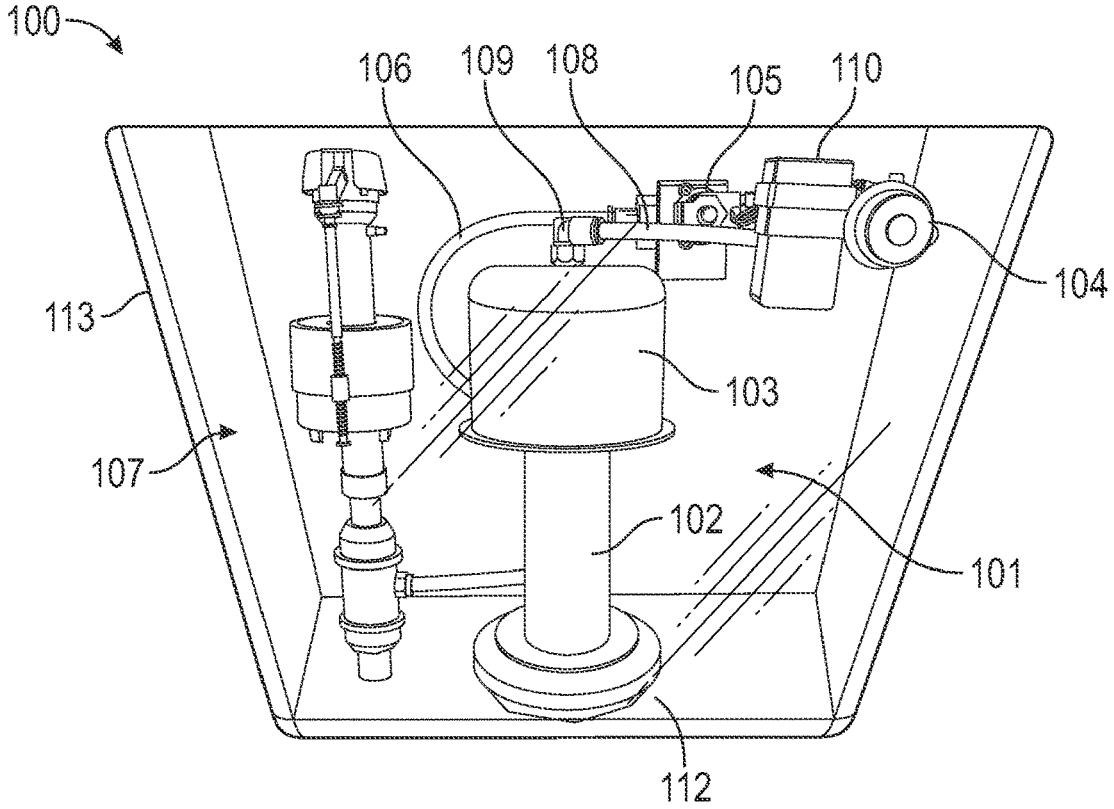

FIG. 1A and FIG. 1B depict a toilet tank assembly 100 in a top view and front view, respectively, according to one embodiment. Shown are siphon valve assembly 101 comprising tubular core 102 and dome-shaped head 103 disposed in tank 113. In this embodiment, siphon valve assembly 101 is configured to be automatically electrically initiated via presence sensor 104. Upon detection of presence and subsequent absence of a user, sensor 104 will signal solenoid valve 105 to open, causing fluid flow from first pressure line 106, coupled to fill valve 107, through second pressure line 108 to a spray initiator (not visible) coupled to spray fitting 109 in head 103 and into tubular core 102 to initiate a siphon. Upon initiation of a siphon, flush water will exit core 102 through outlet 112 to a bowl (not shown). Sensor 104 is in electronic communication with one or more batteries in battery housing 110 and electrical wires 111.

Figure 2A:
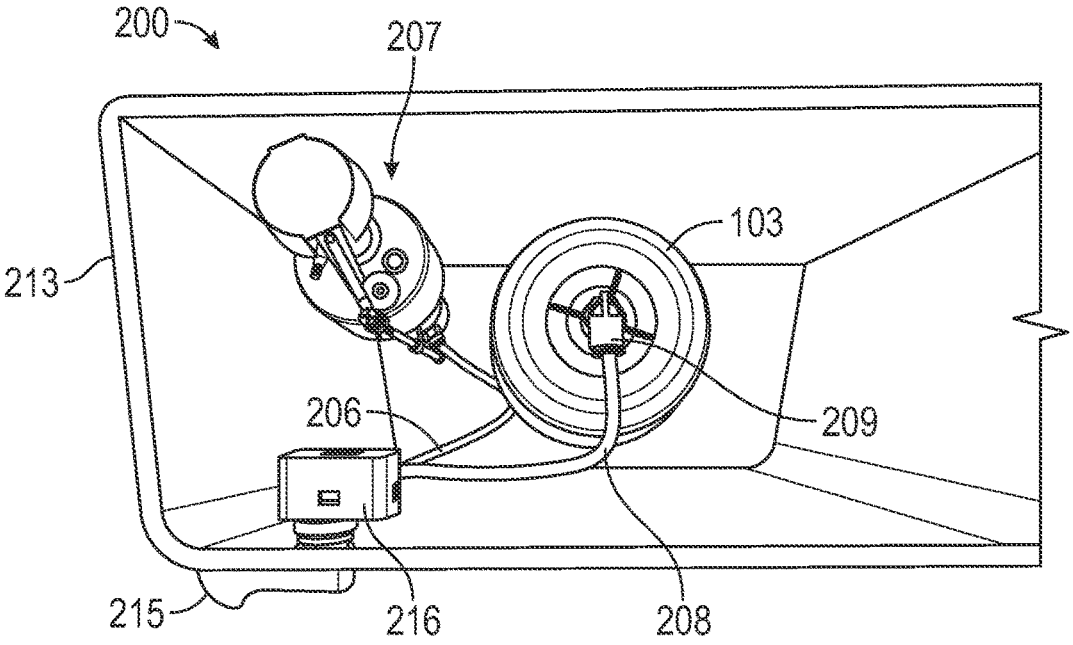
FIG. 2A and FIG. 2B depict a toilet tank assembly comprising a siphon valve assembly, according to an embodiment.
Figure 2B:
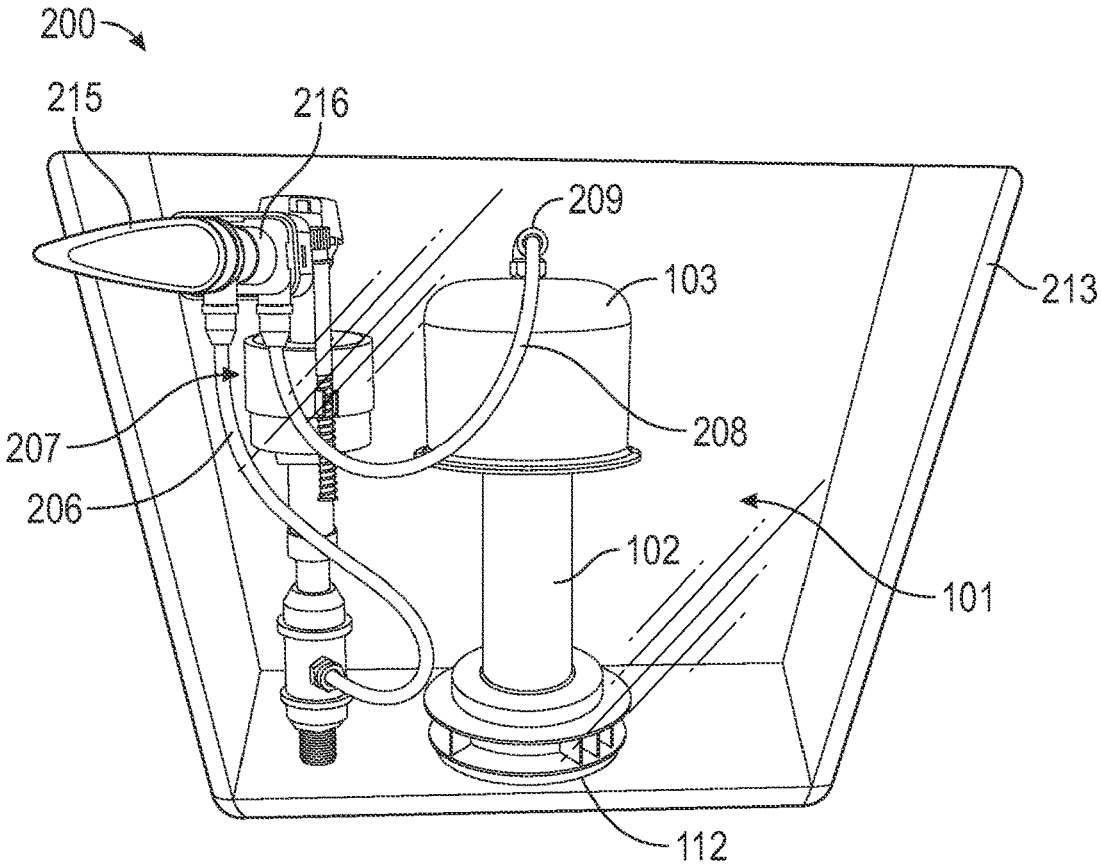

FIG. 2A and FIG. 2B show toilet tank assembly 200 in a top view and front view, respectively, according to one embodiment. Shown are siphon valve assembly 101 comprising tubular core 102 and head 103 disposed in tank 213. In this embodiment, siphon valve assembly 101 is configured to be manually initiated via manual flush handle 215. Handle 215 is configured to actuate activation valve 216. Upon actuation of valve 216, pressurized water will flow through first pressure line 206, and through second pressure line 208 to a spray initiator (not visible) coupled to spray fitting 209 in dome-shaped head 103 and into tubular core 102 to initiate a siphon. First pressure line 206 is coupled to fill valve 207 and activation valve 216. Upon initiation of a siphon, flush water will exit core 102 through outlet 112 to a bowl (not shown). A fluid pressure line (fluid supply line) may be coupled to a flush valve via an inlet valve as shown, or independently from a fluid source.

Figure 3:
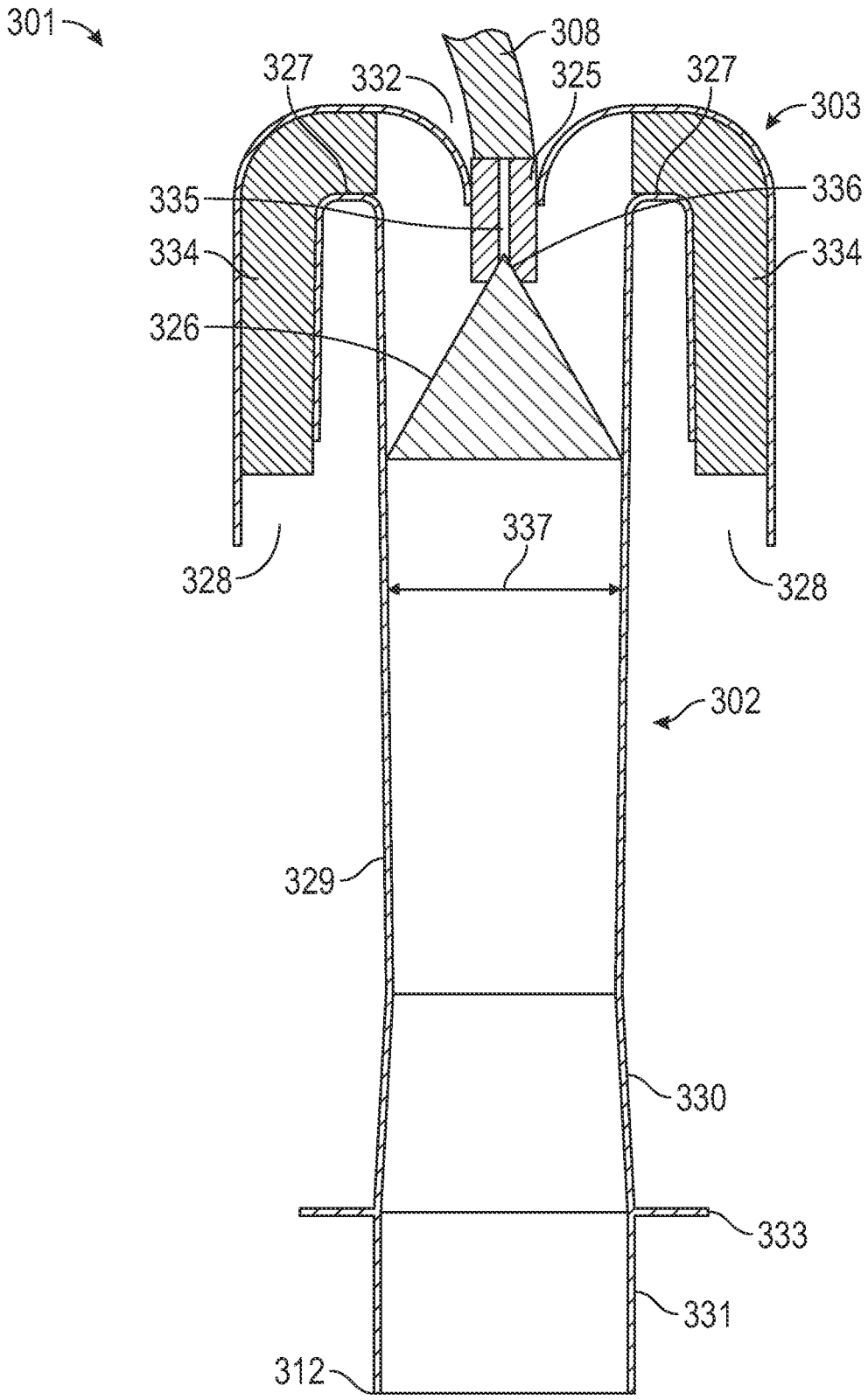
FIG. 3 shows a siphon flush valve in cross-section, according to an embodiment, including showing spray from a fluid supply line and a spray initiator.

FIG. 3 depicts a cutaway view of a flush valve assembly 301 according to an embodiment. Assembly 301 comprises tubular core 302 and dome-shaped head 303. Disposed in head 303 is spray initiator 325. Initiator 325 comprises substantially constant diameter portion 335 and outwardly tapered portion 336. Outwardly tapered portion 336 may be substantially cone-shaped and configured for water to discharge from initiator 325 in a substantially cone shape 326 into core 302 and onto interior wall 337 of core 302. An outwardly tapered portion may provide an angle of spray between about 50 degrees and about 120 degrees. A surrounding fluid of a toilet tank may have a level between weir 327 and flush valve inlet 328. Upon initiation of a siphon, surrounding fluid will enter inlet 328, pass over weir 327, through tubular core 302 and to a bowl (not shown) via outlet 312 to initiate a flush. As a surrounding fluid level drops, the siphon will break when air enters inlet 328 and a flush will stop. In this embodiment, core 302 comprises a first substantially tubular section 329, a tapered section 330, and a second substantially tubular section 331, and wherein an upper portion of the first substantially tubular section curves outward at weir 327 and extends longitudinally downward from the weir. In this manner, head 303 and an upper portion of core 302 may be substantially concentric. Head 303 may comprise a concave section 332 surrounding initiator 325 and fluid supply line 308. A core may include a flange 333 extending outwardly from an outer surface of a tubular core and align a siphon flush valve with a tank opening and maintain a siphon flush valve therein. The cutaway view of assembly 301 shows splines 334 disposed in head 303. Splines are further described in FIG. 4.

Figure 4:
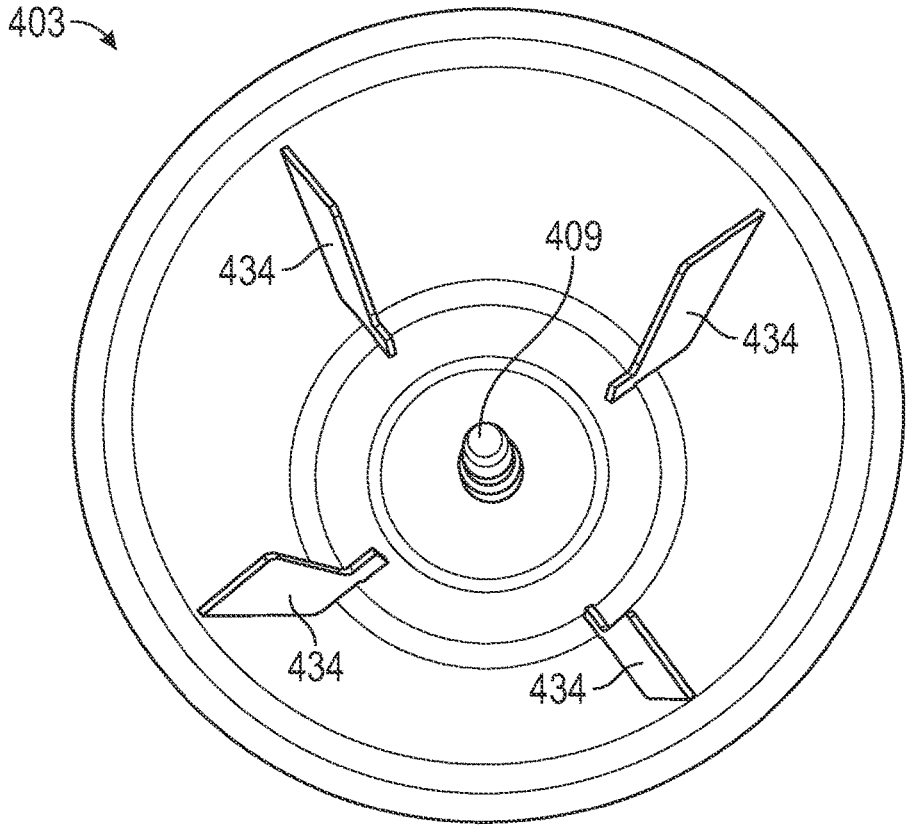
FIG. 4 shows an underside of a siphon valve head, according to an embodiment.
Figures 5A, 5B, 5C, 5D:
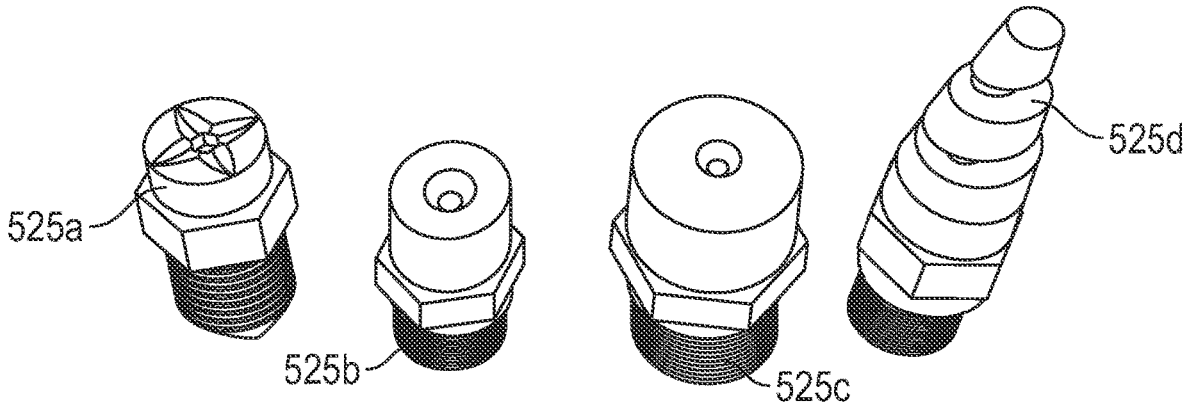
FIG. 5A, FIG. 5B, FIG. 5C, and FIG. 5D show a spray initiator of a siphon flush valve, according to certain embodiments.

FIG. 4 shows a siphon valve head 403 from an underside, according to an embodiment. Head 403 comprises a dome or cap shape. An opening in head 403 is fitted with spray fitting 409 which will couple to a spray initiator (not shown). Head 403, as shown, may have a plurality of splines 434 extending from an inner surface of head 403. Although four splines 434 are depicted, more or fewer splines 434 may be provided. Splines 434 may locate and hold head 403 in place on an upper portion of a tubular core. Splines 434 may rest on upper portion of a tubular core. Alternatively, splines 434 may provide a friction fit with an upper portion of a tubular core. Alternatively, splines 434 may be secured with other connection types (e.g. adhesion or fastening) to a tubular core. Splines 434 may be generally L-shaped. Splines 434 may extend from a top inner surface and/or inner wall surface. Splines 434 may be coupled to a top inner surface and inner wall surface of head 403. Splines 434 may be molded or formed with head 403. Alternatively, splines 434 may be formed separately and coupled to head 403, for example, by gluing or fastening. Splines 434 may be full length, extending along the entire length of head 403 or splines 434 may be partial length, extending along a portion of the length of head 403. Splines 434 may centrally locate head 403 on a tubular core. Splines 434 may extend to top of head 403 and may aid in determining a vertical position. Splines 434 may create a radially and vertically extending space (a flow path) between upper portion of a core and an inner surface of head 403. A radially and vertically extending space may be an annular space. An annular space between upper portion of a core and an inner surface of head 403 may be configured for water to flow into a siphon flush valve, through an inlet, over a weir, and into a bore of a tubular core. A configuration of splines 434 may vary depending upon the desire annular space and flow path.

Figure 6A:
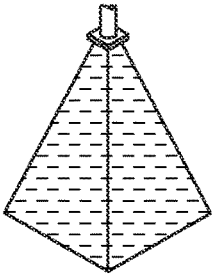
FIG. 6A, FIG. 6B, and FIG. 6C show spray patterns of spray initiators, according to some embodiments.
Figure 6B:
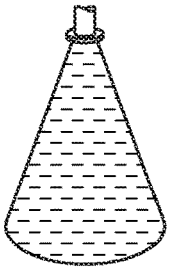
Figure 6C:
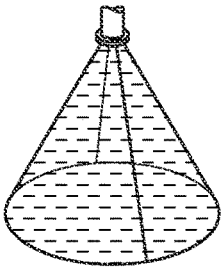

FIG. 5A, FIG. 5B, FIG. 5C and FIG. 5D, show spray initiators 525*a*, 525*b*, 525*c*, and 525*d*, according to certain embodiments. Spray initiators 525*a*, 525*b*, 525*c*, and 525*d* comprise a central bore. Spray initiator 525*d* is a "pigtail"

initiator. A bore may comprise a shape that provides a certain shaped fluid spray, for instance a substantially square or pyramid-shaped spray, such as depicted in FIG. 6A, and which may be provided by spray initiator 525*a*. Initiator 525*b* may have a bore shape that may provide a substantially cone-shaped spray, such as a solid cone-shaped spray as depicted in FIG. 6B. Initiator 525*c* may also have a bore shape that may provide a solid cone-shaped spray as depicted in FIG. 6B. Initiator 525*d* may have a bore shape that may provide a hollow cone-shaped spray, as depicted in FIG. 6C. A spray pattern of initiators 525*a*, 525*b*, 525*c*, and 525*d* may make a full perimeter contact with a bore of a tubular core. Full perimeter contact may provide a water seal within a siphon flush valve and assist in initiating a siphon effect and a flush.

Figure 7:
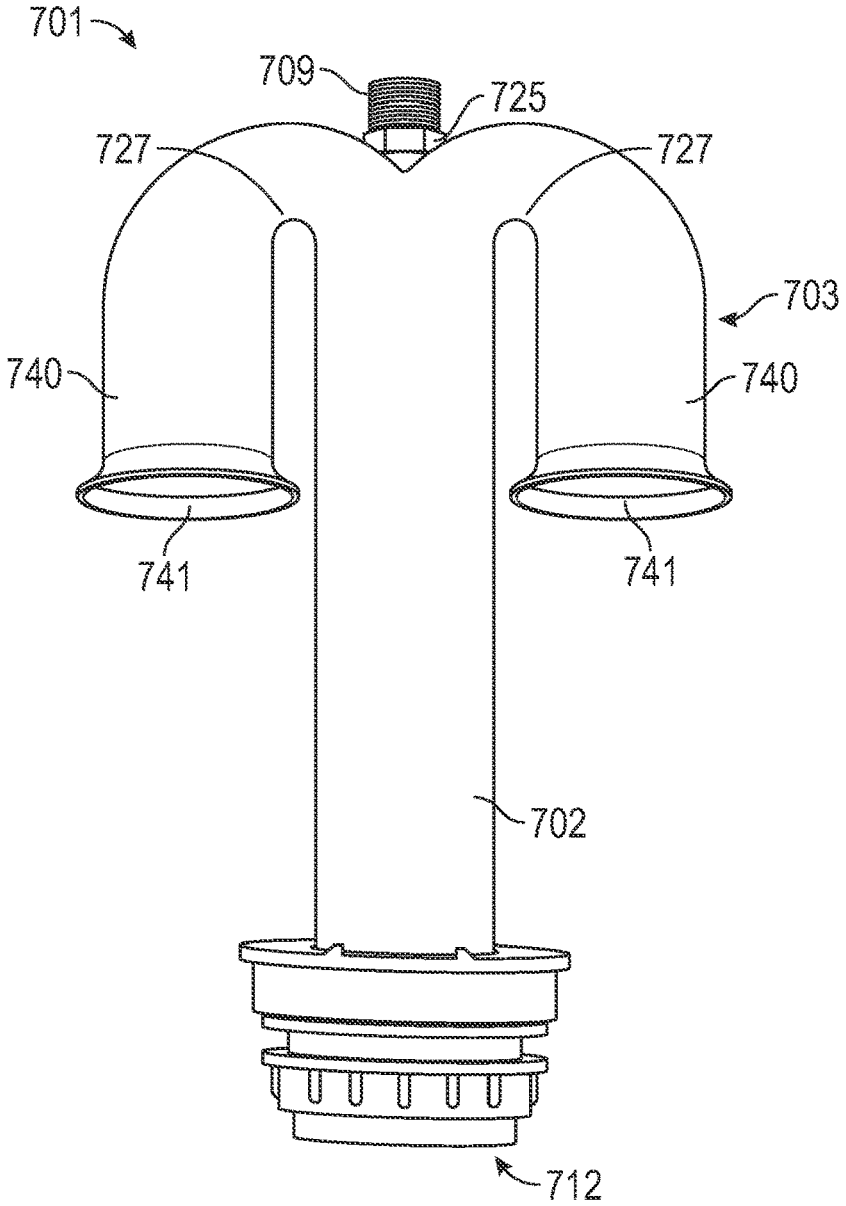
FIG. 7 displays a flush valve assembly, according to an embodiment.

FIG. 7 depicts a non-concentric siphon flush valve assembly 701, according to an embodiment. Siphon flush valve 701 contains an initiator 725 having a supply fitting 709 located at a top of a core 702. Initiator 725 may be the same or similar as any of the initiators previously described. Core 702 may be the same or similar as any cores previously described. Core 702 may have a varied diameter bore. Core 702 may have a diverging bore. In siphon flush valve 701, head 703 may take a form of two inlet pipes 740 arranged symmetrically about core 702. Each inlet pipe 740 may have a flared inlet 741. Flared inlets 741 may allow increased and improved flow into siphon flush valve 701. Each inlet pipe 740 may comprise a weir 727. Siphon flush valve 701 may operate in the same or similar manner as the previously described siphon valves with the exception that fluid flow enters siphon flush valve 701 through flared inlets 741. Surrounding tank fluid may flow from flared inlets 741, over weirs 727, through bore of core 702 and out a siphon flush valve outlet 712. Tank fluid may flow through flared inlets 741 simultaneously or substantially simultaneously. Tank fluid may flow uniformly through both inlet pipes 740. In other embodiments, a head may comprise a plurality of inlets or inlet pipes, for example, 2, 3, 4, 5, 6, 7, 8, or more inlet pipes.

Figures 8A, 8B, 8C:
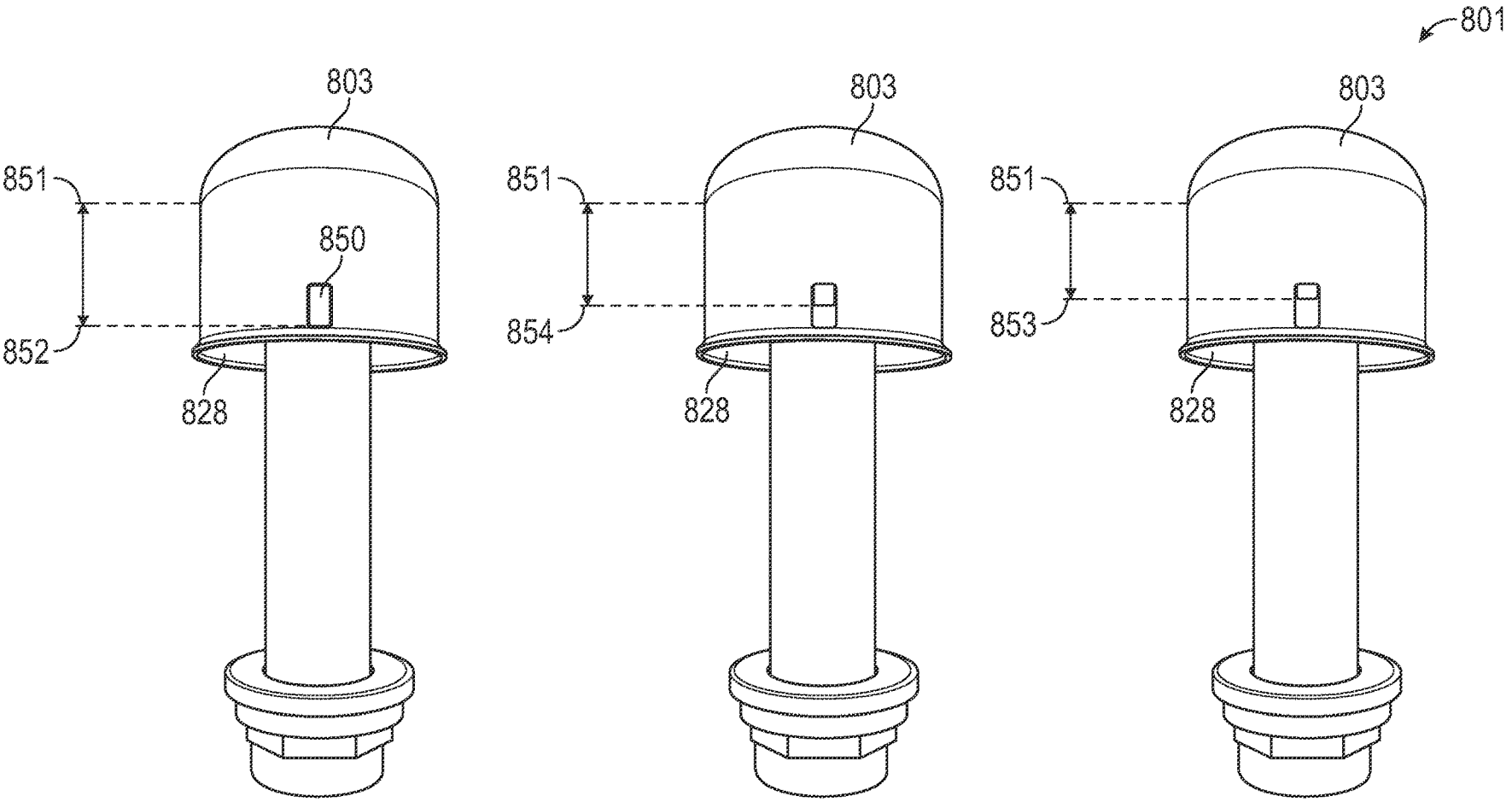
FIG. 8A, FIG. 8B, and FIG. 8C show a flush valve assembly, according to an embodiment.

FIGS. 8A, FIG. 8B, and FIG. 8C, show another siphon flush valve assembly 801, according to an embodiment. Siphon flush valve 801 includes a gate 850. Gate 850 may be selectively opened or closed to adjust a gate opening located in head 803. Gate 850 may be a sliding gate. Gate 850 may allow a siphon to be selectively ended. That is, gate 850 may control the end of a siphon effect and thus control the end of a flush. Gate 850 may allow for a siphon to end at a particular point, thus tailoring a flush discharge volume. Gate 850 may allow more or less fluid than a normal flush to be discharged from the tank to the toilet bowl. That is, an amount of fluid allowed to discharge from a toilet tank may be dependent on the height of gate 850. Other heights of gate 850 may be provided. More than one gate 850 may be provided.

As previously described, when air enters siphon flush valve inlet 828, a siphon effect is ended and a flush cycle is ended. With gate 850 in a fully closed position of FIG. 8A, a siphon may break or end when the tank water level falls to a first ending water level 852. This may allow air to enter the valve through siphon flush valve inlet 828. This may allow for a maximum or full discharge of a fluid from the tank to the toilet bowl. A position of FIG. 8A may discharge a total volume between first ending water level 852 and a beginning water level 851.

With gate 850 in a fully open position of FIG. 8C, a siphon may break or end when the tank water level falls to a second ending water level 853 prior to first ending water level 852. Since gate opening of FIG. 8C is located at a higher vertical location than siphon flush valve inlet 828 and since gate opening is open, air will enter siphon flush valve 800 prior to first ending water level 852. With gate 850 open and gate opening exposed, air may be permitted to enter a siphon prior to a condition of FIG. 8A. This may result in the ending of a siphon effect sooner than a condition of FIG. 8A. A position of FIG. 8C may discharge a total volume between second ending water level 853 and the beginning water level 851. This total volume may be a minimum discharge allowed by the toilet. This total volume may be smaller than the volume discharged in a condition of FIG. 8A.

With gate 850 in an intermediate position, as shown in FIG. 8B, a siphon may break or end when the tank water level falls to a third ending water level 854 prior to first ending water level 852. Third ending water level 854 may be between second ending water level 853 and first ending water level 852. Since a gate opening is located at a higher vertical location than siphon flush valve inlet 828 and since gate opening is open, air will enter siphon flush valve 800 prior to first ending water level 852. With gate 850 open and gate opening exposed, air may be permitted to enter a siphon prior to a condition of FIG. 8A. This may result in the ending of a siphon effect sooner than a condition of FIG. 8A. Since gate 850 is open such that a gate opening is lower than a condition of FIG. 8C, a siphon effect may be ended later than a condition of FIG. 8C. A position of FIG. 8B may discharge a total volume between third ending water level 854 and the beginning water level 851. This total volume may be an intermediate discharge allowed by the toilet. This total volume may be smaller than the volume discharged in a condition of FIG. 8A and larger than the volume discharged in a condition of FIG. 8C. A position of gate 850 may be selectively positioned at any number of positions between a condition of FIG. 8A and a condition of FIG. 8C such that a selective volume of fluid may be discharged from a tank to a toilet bowl. Gate 850 may be selectively controlled by an actuator or controller, similar to the actuators and controllers described herein.

Gate 850 may comprise a door or sliding member extending over a gate opening. Gate 850 may be slidably coupled to head 803 of siphon flush valve 800. Gate 850 may alternatively by hinged, pivotally coupled or rotatably coupled, or other moveable coupling, to head 803 to allow for selective opening and closing of a gate opening. A gate opening may be a hole or aperture in head 803. A gate opening may be a sliding gate that slides to adjust the opening for more or less discharge volume. Alternative coupling types may be used, for example, detents, clips, ratchets, etc. A gate opening and gate 850 may be substantially rectangular in shape, although other shapes may be provided. Although a single gate opening and gate 850 are depicted, more than one may be provided. Gate openings and gates 850 may be symmetrically or asymmetrically disposed around a circumference of head 803.

Figure 9A:
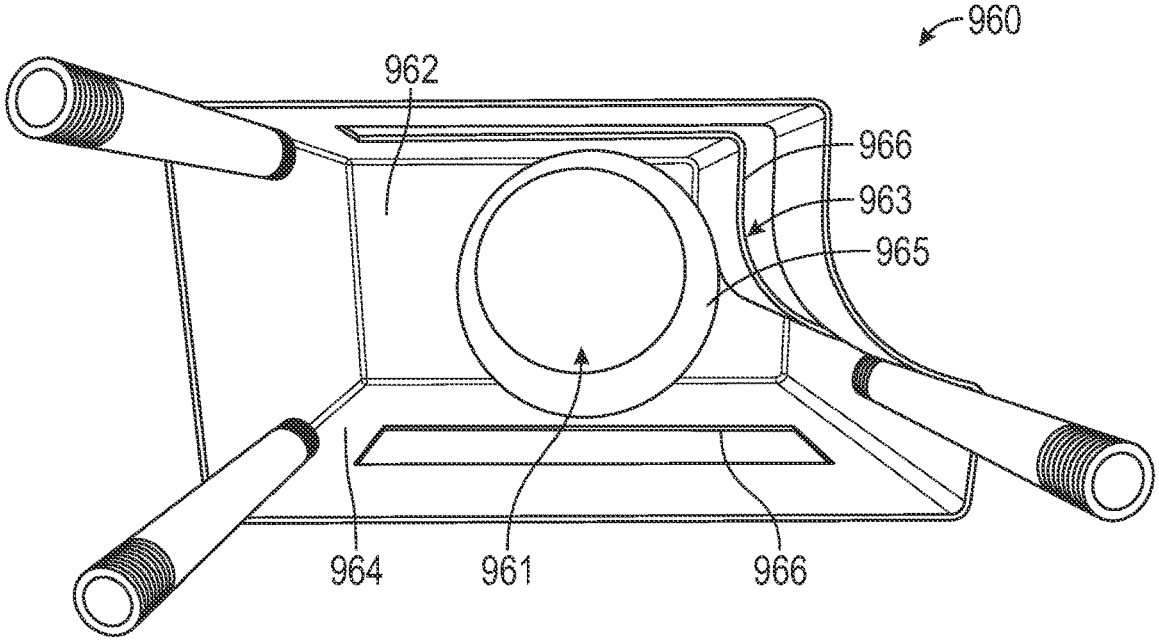
FIG. 9A and FIG. 9B show views of a container to receive a siphon valve assembly, according to an embodiment.
Figure 9B:
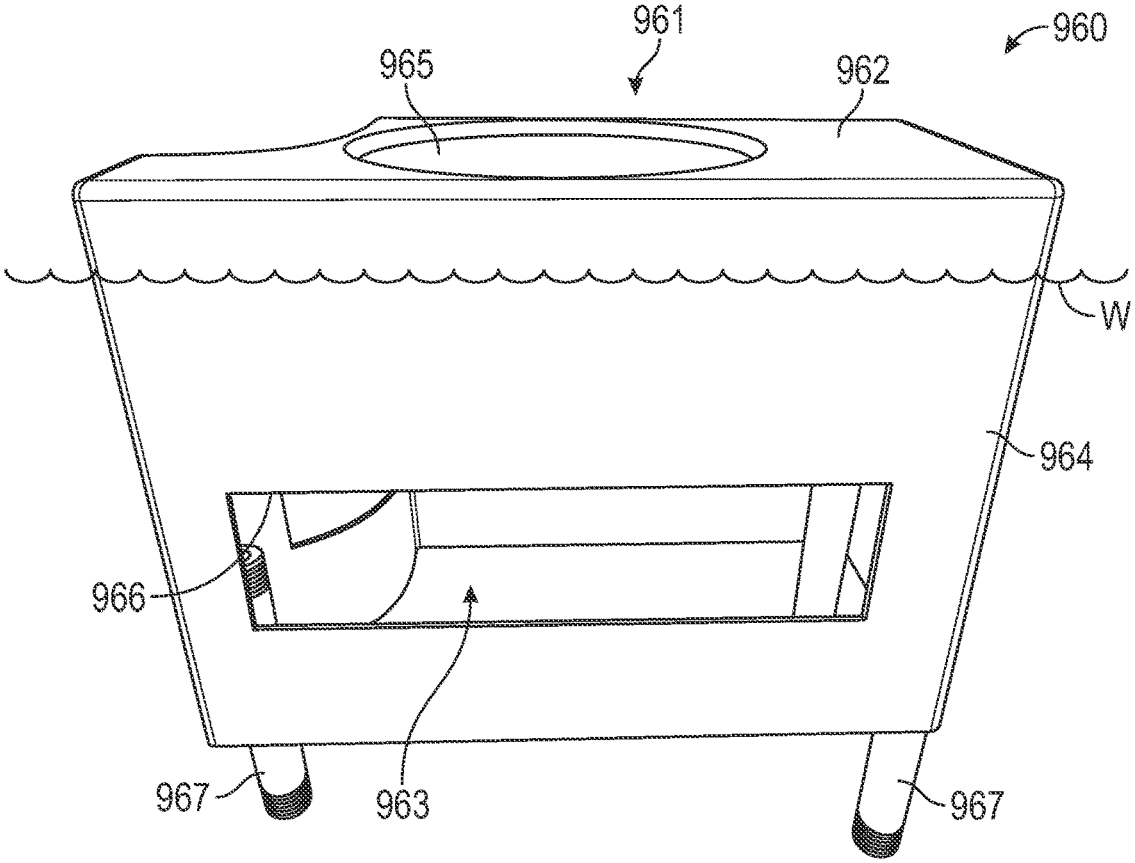

FIG. 9A and FIG. 9B show a bottom view and a front view of container 960, respectively, according to an embodiment. Container 960 contains opening 961 to receive a siphon flush valve assembly. Container 960 comprises a closed upper end 962, open lower end 963, and container upper walls 964. Container 960 is configured to sit in a toilet water tank and to receive a siphon flush valve in opening 961. Container upper walls 964, opening wall 965, closed upper end 962, and lower edge 966 define an interior space of container 960. Opening wall 965 extends downward to about the same point as lower edge 966. An interior space of container 960 may contain a toilet tank water portion and an air portion between flush cycles. Water level W represents a toilet water tank level prior to initiation of a flush cycle (between flush cycles), according to an embodiment. Water level W will also sit between a weir and an inlet of a siphon flush valve between flush cycles. An interior of container 960 will hold tank water from level W to wall lower edge 966, and will hold an air portion from water level W to closed upper end 962, when at rest between flush cycles. In an embodiment, legs 967 may be provided. Legs 967 may be adjustable to which may allow adjustment of air pressure.

Figure 9C:
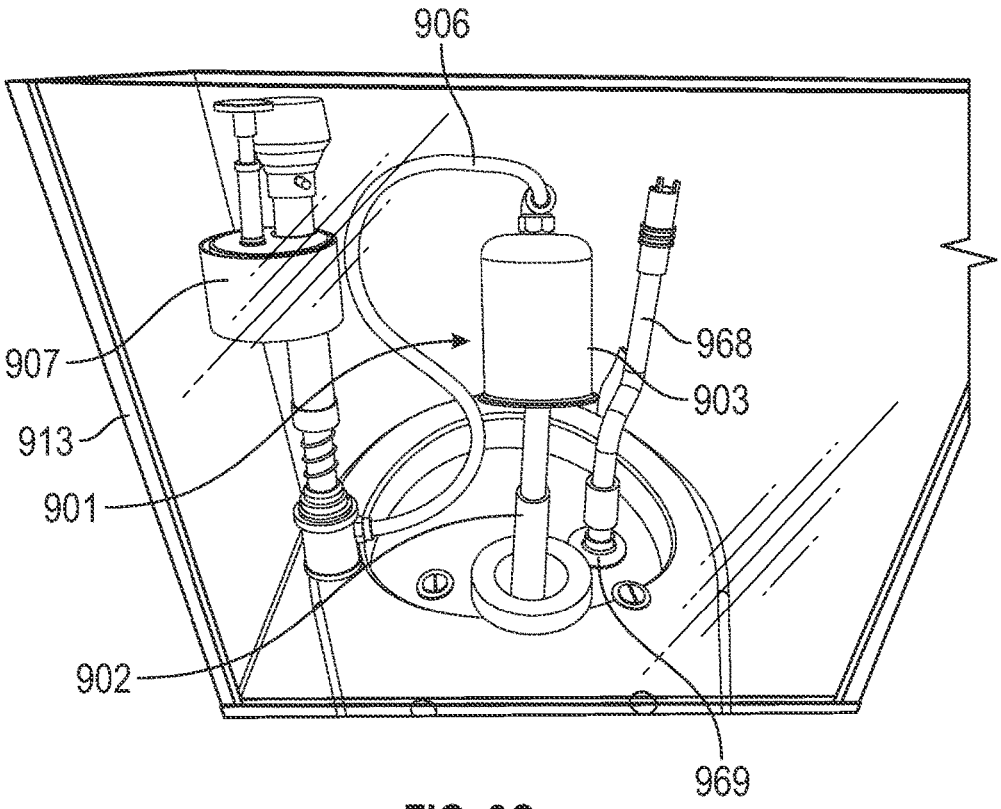
FIG. 9C provides a view of a partial toilet tank assembly, according to an embodiment.

FIG. 9C provides a view of fill valve 907, first pressure line 906, siphon valve assembly 901, and conduit 968 positioned in see-through toilet tank 913, according to an embodiment. Siphon valve assembly 901 comprises head 903 and tubular core 902. An upper end of conduit 968 is configured to be positioned above a water line W in an air portion of container 960 as depicted in FIG. 9A and FIG. 9B. Conduit 968 may be coupled to a conduit portion of a bowl and to a trapway via coupling 969. A "conduit" in total means from an upper end of a conduit to a connection point at a trapway.

Figure 9D:
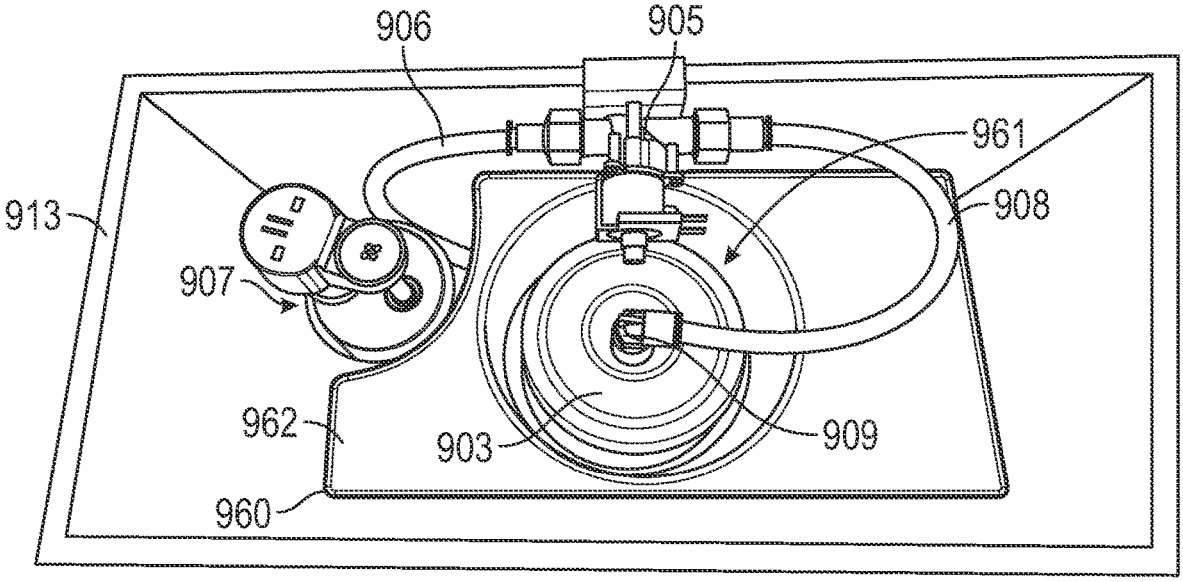
FIG. 9D provides a top view of a toilet tank assembly, according to an embodiment.

FIG. 9D shows a top view of a toilet tank assembly comprising tank 913, fill valve 907, and container 960, with siphon valve assembly 901 positioned in opening 961, according to an embodiment. Visible is head 903 of siphon valve 901 and closed upper end 962 of container 960. Also visible is first pressure line 906 running from fill valve 907 to solenoid 905, and second pressure line 908 running from solenoid 905 to spray fitting 909.

As water level in container 960 falls upon initiation of a flush cycle, pressure drops in an air volume defined by a combined volume of an upper end of container 960, conduit 968, and a trapway portion between a sump trap and a lower trap (not shown). A drop in pressure will help initiate a siphon to expel flush water and waste out of a bowl and through a trapway. An upper end of container 960, conduit 968, and a trapway portion between a sump trap and a lower trap are in flow communication.

Figure 10:
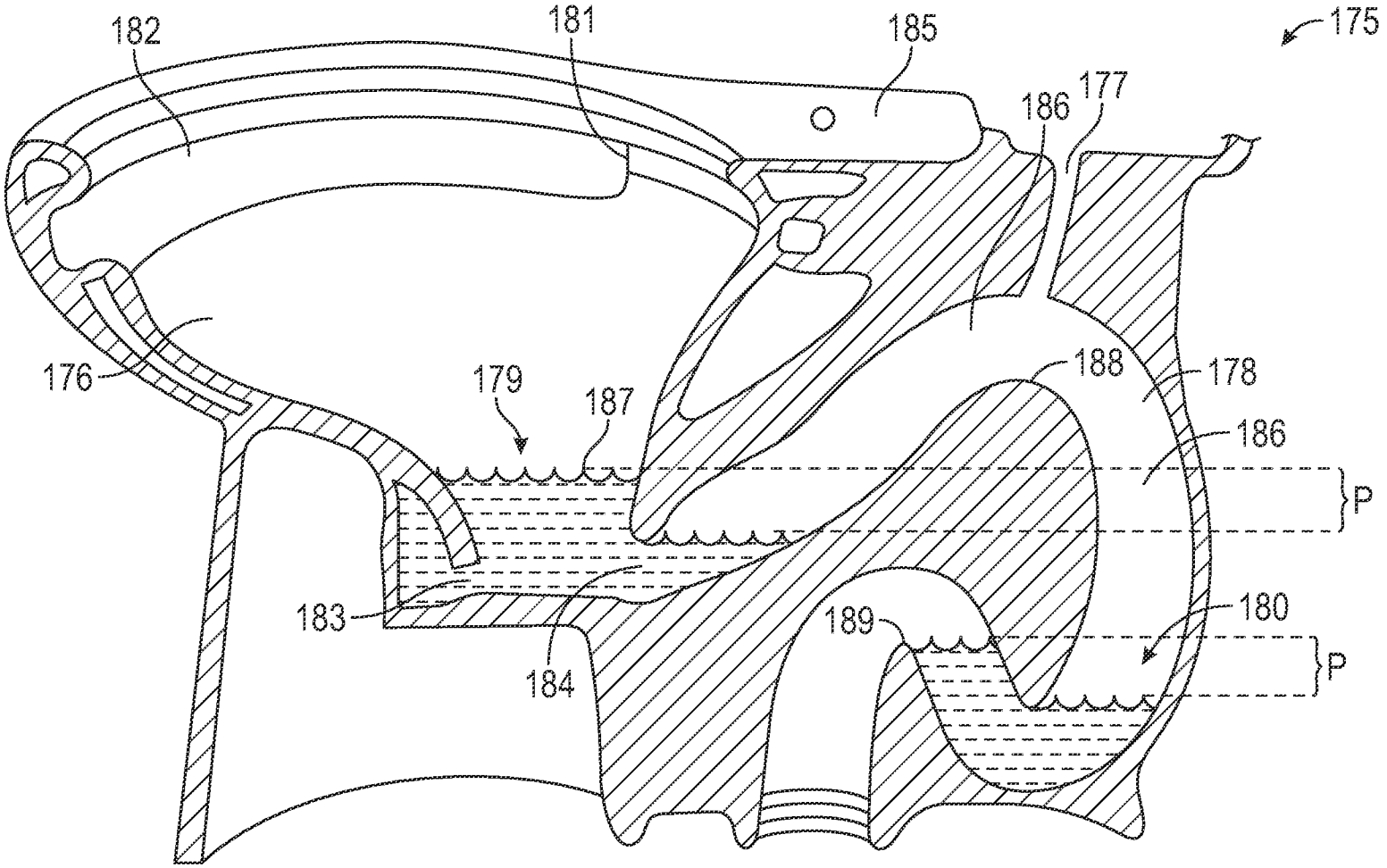
FIG. 10 shows a cross-section view of a toilet assembly, according to an embodiment.

FIG. 10 provides a cross-section view of toilet assembly 175, according to an embodiment. Shown are bowl 176, conduit portion 177, trapway 178, sump trap 179, and lower trap 180. Lower trap 180 is downstream of sump trap 179 and conduit portion 177 is coupled to trapway 178 at a position between lower trap 180 and sump trap 179. Also shown are rim outlet 181 and rim channel 182, and jet outlet 183 and trapway inlet 184. A toilet tank having a siphon flush valve assembly positioned therein (not shown) may be positioned on toilet deck 185. Prior to initiation of a flush cycle, an air volume defined by a combined volume of an upper end of a container (not shown), total conduit, and trapway portion 186 between sump trap 179 and lower trap 180 may be under a positive pressure. Trapway portion 186 may be defined as "portion between sump trap 179 and lower trap 180, meaning from a downstream water level of sump trap 179 to upstream water level of lower trap 180. A positive pressure P is shown, which may be from about 0.5 cm to about 5.0 cm of water above atmospheric pressure. Pressure P results in the presence of a larger water spot 187. Trapway 178 contains first weir 188 and second weir 189.

In some embodiments, a distance between an upper point of weir 189 and a lower point of trapway 178 represented by the fifth dashed line from the top of lower trap 180 may be from about 0.5 cm to about 5.0 cm. In some embodiments, this distance may be from any of about 0.2 cm, about 0.3 cm, or about 0.4 cm, to any of about 0.5 cm, about 0.6 cm, about 0.7 cm, about 0.8 cm, about 0.9 cm, or more. This distance may be termed "upper point of lower trapway wall to lower point of upper trapway wall" in reference to the lower trap.

In some embodiments, an air portion of a container may have a volume of from any of about 100 mL, about 125 mL, about 150 mL, about 175 mL, or about 200 mL, to any of about 225 mL, about 250 mL, about 275 mL, about 300 mL, about 350 mL, about 375 mL, or more. In some embodiments, a container air portion volume compared to a an air volume defined by an upper end of the container (the container air portion), the conduit, and a portion of the trapway between the sump trap and lower trap, is from any of about 5%, about 10%, about 15%, about 17%, about 19%, about 22%, or about 25%, to any of about 28%, about 31%, about 33%, about 35%, or more.

Siphon flush valves of the disclosure are described in U.S. app. No. PCT/US19/37884, filed Jun. 19, 2019 (WO2020005660), the contents of which are hereby incorporated by reference.

According to an embodiment, a siphon flush valve for a toilet may include a core configured to couple to a toilet tank opening; a head coupled to a top of the core, the head having a head opening; an initiator coupled to the head opening; a siphon flush valve inlet; and a siphon flush valve outlet. An initiator may be configured to induce a siphon flow of a surrounding fluid, through the siphon flush valve inlet, and exiting through the siphon flush valve outlet. In some embodiments, a surrounding fluid may be in a toilet tank, wherein a starting (standing) water level will be above a siphon valve inlet defined by a lower end of the head.

A head may be a substantially cylindrical cap located around (about) the core. In some embodiments, the head may be a substantially cylindrical cap located substantially concentrically around the core. A head opening may be located in a center of a substantially cylindrical cap and wherein the initiator extends downward from the opening into the core.

In some embodiments, the core may include weir located at an upper surface or edge of the core. In some embodiments, a core may be substantially tubular. A core may comprise a substantially hollow cylinder-like tube having open top and bottom ends. "Tubular" may mean tube-like (shaped like a tube). In some embodiments, a core may include a first substantially tubular section, a tapered section, and a second substantially tubular section. In some embodiments, an upper portion of a tubular core curves outward at the weir and extends longitudinally downward from the weir. In some embodiments, an upper section curves outward at the weir and extends longitudinally downward parallel to an outer surface of the tubular core.

In some embodiments, a tubular core comprises an inner wall surface and an outer wall surface, wherein a fluid spray initiator is configured to spray pressurized fluid on an entire perimeter of the inner wall surface to form a fluid seal, thereby creating negative pressure in the tubular core and initiating a siphon flow to initiate a flush.

A siphon flush valve may include a flow path defined between an inner surface of the head and an outer surface of the core. In some embodiments, the initiator may include a bore having a substantially constant diameter. In some embodiments, the initiator may comprise a tapered bore. In some embodiments, the initiator may have a bore tapered outwardly (downward) in a cone shape. A tapered bore may be configured to provide a shaped fluid spray. A siphon flush valve inlet may be located at a lower end of the head and the siphon flush valve outlet is located at a lower end of the core. A siphon flush valve may include an internal cavity, wherein the siphon flush valve inlet is configured such that the internal cavity has a first pressure when at a tank starting water level and a second pressure when at a tank ending water level.

In some embodiments, a surrounding fluid may have a starting level at a point above the siphon flush valve inlet and an ending level at a point at or below the siphon flush valve inlet. The terms "starting" and "ending" meaning prior to and at the end of a siphon flush (flush cycle). A siphon flush may end when a fluid level reaches a flush valve inlet and air enters the valve, breaking the siphon. A surrounding fluid surrounds the siphon flush valve, for instance as in a toilet tank.

An initiator may be a spray initiator. A spray initiator may be a pressurized spray initiator. A siphon flush valve inlet may be positioned with a first configuration below a tank starting water level and a second configuration above a tank ending water level. A head and the core may be longitudinally axially aligned.

A siphon flush valve may be flapperless. A siphon flush valve inlet may be located circumferentially around the core. A head may be a dome and wherein the dome is wider than the core to define the siphon flush valve inlet. An initiator may be configured to discharge a pressurized fluid into the core in a cone-shaped spray.

An initiator may be configured to create a pressure differential between a bore of the core (the core bore) and a toilet tank. A head may be located around the core such that the siphon flush valve inlet and a flow path are formed between the head and the core. In some embodiments, the head may be located substantially concentrically around the core. A siphon flush valve may be configured without moving parts.

According to an embodiment, a siphonic flush valve system for a toilet may include a siphon flush valve, the siphon flush valve having a core coupled to a toilet tank opening, a head having a head opening and attached at a top of the core, and an initiator coupled to the head opening, a siphon flush valve fluid supply line coupled to the initiator; a fluid supply valve coupled to the siphon flush valve fluid supply line; and an actuator configured to open the fluid supply valve to initiate a flow of pressurized fluid in the siphon flush valve fluid supply line. An initiator may be configured to supply a flow of pressurized fluid to the core to initiate a siphon flow of a surrounding fluid in a toilet tank, through the siphon flush valve, and into a toilet bowl.

An initiator may be configured to discharge flow of pressurized fluid to the core in a cone-shaped spray. An initiator may be configured to create a pressure differential between a bore of the core and the toilet tank. A siphonic flush valve system may include a flow path from a siphon flush valve inlet and a siphon flush valve outlet and wherein the siphon flow flows through the flow path. A flow path may extend from the siphon flush valve inlet, through a space between the core and the head, over a weir on the core, though a bore of the core, and to the siphon flush valve outlet.

A head may be located around the core such that a siphon flush valve inlet and a flow path are formed between the head and the core. A core may include a weir and a down leg portion and wherein the initiator extends into the down leg portion. A siphon flush valve may be configured to empty fluid in the toilet tank from a starting water level adjacent the weir to an ending water level adjacent a siphon flush valve inlet.

In some embodiments, an actuator may be an electronic actuator in electronic communication with a fluid supply valve and configured to open and close the fluid supply valve. Electronic communication may be wired or wireless. An actuator may be a toggle switch, a button, a lever, a knob, a handle, etc. In other embodiments, an actuator may be hydraulic, pneumatic, mechanical, or hydro-mechanical. In some embodiments, an electronic actuator may be associated with a battery and/or another power source.

In some embodiments, a fluid supply valve may be configured to be actuated manually and/or automatically.

In some embodiments, a fluid supply valve may be associated with a sensor, for instance a presence sensor such as an infrared (IR) sensor. In some embodiments, a solenoid valve may be in electrical communication with a controller (microcontroller or printed circuit board) in electrical communication with a sensor. A controller/sensor assembly may be configured to actuate a solenoid valve upon detecting an event, for example detecting an exit of a user. In some embodiments, associated sensors may include one or more of IR sensors, proximity sensors, pressure sensors, photoelectric sensors, optical sensors, motion sensors, ultrasonic sensors, microwave sensors, capacitive sensors or resistive-touch type sensors.

In certain embodiments, a fluid supply valve may be configured to close after a certain amount of time has elapsed after being opened. In some embodiments, a manual actuation system may be configured to close a supply valve after a certain period of time. A period of time may extend beyond a "siphon break" to provide fluid to refill a toilet bowl to provide a bowl seal. In some embodiments, a fluid supply valve may be associated with a timer or clock. In some embodiments a controller associated with a fluid supply valve may comprise a timer function and configured to open a supply valve and to close the supply valve after a certain amount of time has elapsed.

A siphon flush valve may be flapperless. A siphon flush valve may have no moving parts. A fluid supply valve (supply valve) may be a solenoid valve. An actuator may be configured to close a fluid supply valve to terminate flow of pressurized fluid in the siphon flush valve fluid supply line.

According to an embodiment, a method for siphonic flow through a siphon flush valve in a toilet may include supplying a pressurized fluid to an initiator in a siphon flush valve; discharging the pressurized fluid into the siphon flush valve to create a pressure differential inside the siphon flush valve; initiating a siphon flow of a fluid in a toilet tank; flowing fluid in the toilet tank from a siphon flush valve inlet to a siphon flush valve outlet; and terminating the siphon flow of fluid from the toilet tank when an ending fluid level in the toilet tank is reached.

A method comprising supplying the pressurized fluid to the initiator may comprise opening a solenoid valve via an actuator to initiate a flow of the pressurized fluid through a siphon flush valve fluid supply line.

A method may include discharging the pressurized fluid into the siphon flush valve comprising discharging the pressurized fluid in a full cone-shaped spray, hollow cone-shaped spray, or square cone-shaped spray.

A method may include initiating the siphon flow of fluid in the toilet tank comprising causing fluid in the toilet tank to rise up to the siphon flush valve inlet, spill over a weir in the siphon flush valve, and flow through a down leg portion of the siphon flush valve to the siphon flush valve outlet. A method may include terminating the siphon flow comprising introducing air into the siphon flow. A method may include terminating the pressurized fluid through the initiator at a predetermined time after the siphon flow is initiated. A method may include discharging fluid in the toilet tank from the siphon flush valve outlet to a toilet bowl. A method may include a starting fluid level at a height of a weir in the siphon flush valve and an ending fluid level at a height of the siphon flush valve inlet.

According to an embodiment, a siphonic flush valve may include a flush valve body; a flush valve bore within the flush valve body; and a spray initiator in fluid communication with the flush valve bore. A spray initiator may be configured to discharge a pressurized fluid in contact with an entire perimeter of the flush valve bore to create a fluid seal within the flush valve bore thus initiating a siphon flow within the flush valve.

A spray initiator may be configured to create a negative pressure differential in the flush valve bore to initiate the siphon flow. A spray initiator may be configured to discharge the pressurized fluid in a full cone-shaped spray, hollow cone-shaped spray, or square cone-shaped spray, among other shapes.

According to an embodiment, a method for initiating fluid flow in a flush valve of a toilet may include discharging a pressurized fluid from a spray initiator in a flush valve; contacting an entire perimeter of a bore of the flush valve with the pressurized fluid; creating a fluid seal within the bore; creating a negative pressure differential in the bore; initiating a siphon flow in the flush valve; and discharging fluid from a toilet tank to a toilet bowl with the siphon flow.

A spray initiator may be a sprayer, spray initiator, and/or a nozzle. A spray initiator may be secured within a head opening via adhesion, friction fit, press fit, threads, glue, overmolding, screw threads, bayonet threads, or other types. A spray initiator may be formed as a unitary, single body or may be formed from a plurality of parts coupled together. An initiator may have a substantially cylindrical outer surface with a bore therethrough. An initiator may be tubular in shape. An initiator may have a flange configured to secure to a lower surface of a head.

A toilet may be a gravity-fed toilet, a wall hung toilet, a one-piece toilet, a two-piece toilet, a pressurized toilet, a commercial toilet, a residential toilet, a hands free toilet, a sensor actuated toilet, a manual toilet, etc. An actuator may be manual, electrical, hydraulic, pneumatic, mechanical, or hydro-mechanical. An actuator may be associated with a battery. A supply valve may be associated with an infrared sensor (IR sensor), logic circuit and/or printed circuit board (PCB). During operation, an IR sensor may be activated by a user (e.g. the IR sensor senses when the user moves from a sensor path). An IR sensor may communicate this to a controller which sends a signal to the solenoid to open thus admitting water through a siphon flush valve fluid supply line. A solenoid may be programmed to open for a predetermined time or to be opened and closed, respectively, based on signals from a controller.

A tubular core may have a choke point at a transition from a first substantially tubular section to a tapered section. A choke point may be configured to improve flow dynamics and efficiencies. A choke point may improve flow dynamics and efficiencies, for example, due to a divergence of a tubular core bore. A divergence of a core bore may be caused by the diameter of bore tapering inwardly and subsequently tapering outwardly. A divergence of a bore may be where a bore extends (or alternatively tapers inwardly) from a first diameter at a top of first substantially tubular section to a choke point and subsequently tapers outwardly during a tapered section to an inner diameter of a second substantially tubular section. A divergence of a bore may increase the velocity or speed of a fluid flowing through a siphon flush valve as compared to a straight bore. An increased velocity of a fluid flow may increase the rate of discharge of fluid from a toilet tank to a toilet bowl, thus enhancing efficiency and performance of a toilet. A core may be substantially tubular. A first substantially tubular section, a tapered section, and a second substantially tubular section may be coupled or integrally formed.

A tapered section may taper outwardly from a first diameter D1 of a first substantially tubular section to a second diameter D2 of a second substantially tubular section. A second diameter D2 may be larger than first diameter D1. A tapered section may taper both internally (e.g. the bore of a tapered section may taper outward) and externally (e.g. the outer surface of a tapered section may taper outward). A core may include a flange extending outwardly from an outer surface of a tubular core. A flange may be located at a lower end of a tapered section and/or at an upper end of a second substantially tubular section. A flange may align a siphon flush valve with a tank opening and maintain a siphon flush valve therein. Enhanced flow, as previously described, may be achieved from a first substantially tubular section and a tapered section due to the expanding bore diameter. An enhanced flow may be divergent flow where under full flow conditions, flow transitions from a choke point gradually diverging outward. This may create flow separation thus increasing a flow velocity through a choke point. A change in diameter may benefit or aid in establishing siphon flow during an initial or transient phase (e.g. during initiation of a siphon flow in a siphon flush valve). Various configurations may be contemplated in accordance with the invention to increase flow velocity and volume. This may also reduce the amount of time and/or flow needed to establish a siphon flow.

A siphon flush valve inlet and a fluid flow path may be substantially annular. A flow path may be defined between an inner surface of a head and an outer surface of a tubular core. A flow path may be defined from a structure of a head and a tubular core, embodiments of which are described herein. A siphon flush valve may have an internal cavity defined by a tubular bore and a flow path. A siphon flush valve may have a longitudinal axis L. A head, initiator, and/or core may be aligned along the longitudinal axis L. A head and core may be concentric about the longitudinal axis L. Where head and core are not circular in cross-section, head and core may still be aligned with center points along the longitudinal axis. A head may be wider and/or have a larger diameter than a tubular core such that siphon flush valve inlet and/or a flow path is defined therebetween. An area defined by a space between a siphon flush valve inlet and an upper portion of a core may be greater than or equal to the area defined by a space between a head apex and a weir. A space between a head apex and a weir may be greater than or equal to the area defined by a top of bore. An initiator may be located such that a spray pattern emitted from initiator contacts the bore at or lower than a weir.

A starting surrounding water level may be at a higher vertical position than a siphon flush valve inlet. A starting water level may be higher than a siphon flush valve inlet to ensure no air exists at a siphon flush valve inlet (e.g. a water seal is present) and to ensure a siphon may be initiated when a flush cycle is started. A starting water level may be at or near the top of a weir. A water level lower than the top of a weir may require a greater pressure differential to initiate siphon flow. A water level higher than the top of a weir may provide for water to spill over and provide a "run on" condition. Surrounding water in a toilet tank which at a starting water level may be water at atmospheric pressure. In an initial condition, surrounding fluid, such as water, may be supplied through a siphon flush valve fluid supply line.

Water may be pressurized water and may be admitted through a solenoid valve that is opened with an actuator. Water may exit a siphon flush valve fluid supply line and discharge into a bore through a spray initiator. Water may exit initiator in a cone pattern. Cone pattern may be substantially cone-shaped, such as, a full cone, a hollow cone, or a square cone shape. A tapered portion of a bore of an initiator may be configured for water to exit an initiator in a cone pattern. That is, since a tapered portion of a bore has a conical shape, water which exits this portion may also take on a conical shape. Discharge of water in a cone pattern into a tubular bore may create a negative pressure differential. A pressure differential may be such that the pressure within a siphon flush valve is lower than the pressure in a toilet tank. A starting surrounding water level in a toilet tank may have an initial condition at atmospheric pressure. Water that flows out of an initiator may be at a higher pressure than the atmospheric pressure of starting surrounding water level. This may create a reduced pressure at a weir and flush valve inlet. A reduced pressure within siphon flush valve induces a siphon effect, pulling water from starting surrounding water into a siphon flush valve inlet, through a flow path, over a weir, into a tubular bore and out a siphon flush valve outlet.

Once a siphon effect has been initiated, the pressurized water from siphon flush valve fluid supply line may be stopped. Pressurized water may be stopped by closing a valve. So long as no air is provided to an interior of a siphon flush valve, water may continue to empty from a toilet tank to a toilet bowl for flushing of a toilet. As water approaches an ending water level, the water level may no longer completely cover a siphon flush valve inlet. Accordingly, air may be permitted to enter siphon flush valve inlet and become entrained with flow of water through the siphon flush valve. With air entering the siphon flush valve inlet, the siphon effect through siphon flush valve is stopped and a flush is stopped.

A height of starting surrounding water level and a height of ending surrounding water level may be selected such that the volume therebetween effectively flushes a toilet. A height between starting surrounding water level and ending surrounding water level may be optimized for a predetermined discharge volume. A fill valve may be controlled to refill a toilet tank to the starting water level. A siphon flush valve inlet may be placed at a height corresponding to a desired ending water level. A system thus may be configured for a fixed flush volume discharge.

Various parameters may be customized or altered in the operation of a toilet and/or siphon flush valve. Such parameters include dimensions and parameters (e.g. diameters, lengths, shape, orientation, etc.) of a siphon flush valve, height of the weir, fluid pressure from the main plumbing source, fluid pressure in a siphon flush valve fluid supply line, dimensions and parameters (e.g. diameters, lengths, shape, orientation, etc.) of the initiator, size and orientation of a siphon flush valve inlet, duration of the initiator discharging fluid, activation time of an actuator, solenoid, and/or initiator, etc. In an exemplary embodiment, a siphon flush valve with the previously described parameters, may have the following parameters to achieve a siphon flush effect to discharge fluid from a toilet tank to a toilet bowl. A solenoid may be open for about 2.5 seconds at about 40 psi and above to initiate siphon flow. Refilling or resealing of a toilet bowl may be achieved by increasing a duration ("ON" time) to dispense additional water for this purpose. Refilling or resealing may be an amount of water needed to refill a toilet bowl to a level to provide a water seal to prevent sewer gasses from traveling through a trapway and up through a bowl. An actuator, solenoid, and initiator may be dual purpose in function; one, to initiate siphon action, and two, to refill a water seal in a toilet bowl after a flush cycle, if the timing is configured to allow this added function. A divergent flow pattern may be used to form a seal between a nozzle and a valve core inside diameter perimeter. Another seal may be created by a starting water level which is at or near a weir height. As water is flowing through a sprayer contacting a core inner perimeter wall and flowing downward, it creates a negative pressure or vacuum to cause atmospheric pressure acting on a free surface to push cistern water up and over the weir and thusly establishing gravity siphon flow. Other flow patterns are contemplated. For example, if, a straight flow column were large enough to contact a core inner perimeter wall, it may generate siphon flow.

A head may have an outer surface having a substantially cylindrical or tubular shape. An outer surface may curve radially outward at a lower end. A lower end may create a concave surface in an outer surface. A lower end may be radiused or profiled to improve flow dynamics and efficiencies. A radiused or profiled lower end may improve flow dynamics by reducing energy losses. An outer surface may extend longitudinally upward from a lower end to an upper end. At an upper end, an outer surface may curve at a curved portion upward from an outer end to an apex and then downward toward a head opening. A head opening may have a substantially cylindrical shape. In a lateral view, a head may appear "donut" shaped.

A siphon flush valve may taper outwardly at the top. A full round feature may form an effective siphon with sprayer technology alone. An outward taper profile, under dynamic flow conditions, at an initial or transient flow stage (air and water) may follow the profile shape, first spilling over at the weir, secondly following the taper downward and thirdly, following vertically downward. As flow, for example, the flow velocity, increases, the flow will separate from the boundary wall at the taper to the vertically downward transition resulting in convergent flow stream toward a center of the valve. As the valve is of substantially circular design in cross-section, the resulting annular flow will meet in the bore of a siphon flush valve and effectuate a seal to allow a pressure differential to form as water flows downward through a bore of a siphon flush valve (e.g. through the down leg portion), thus aiding a siphon effect to develop in the siphon flush valve. A previously described action, combined with a previously mentioned initiator, may be configured for a siphon to form and transition to full siphon (no air) more quickly than a full round weir feature. Other profile shapes may be provided for improving efficiencies.

An upper portion of a tubular core may have an outwardly and downwardly extending shape. An upper portion may include a wall which extends and/or curves from weir outward and downward to a lower surface. A lower surface may be curved or turned inward toward the core from the wall. A weir may be a profiled or radiused throat to provide a flow path with improved flow dynamics and efficiencies. An upper portion may form a gap between an exterior surface of a core and a wall of an upper portion. A gap may be substantially annular. A weir may align with a center of a curved portion of a head. In this manner, when assembled, a head and an upper portion of a core may be substantially concentric. A relationship between a head and an upper portion may provide a siphon flush valve inlet and a flow path for fluid, such as water, to flow from an exterior of a siphon flush valve through a tubular bore. A siphon flush valve inlet and flow path may be annular. An outward curve of a lower surface of a core and an outward curve of a lower end of a head may provide an enlarged siphon flush valve inlet. This may improve flow dynamics and efficiencies.

In some embodiments, a head and tubular core may have shapes other than cylindrical, for instance ovular. A width of a head and a core may be smaller than a length of the head and the core. An oval or elliptical shape of a siphon flush valve may allow siphon flush valve to be accommodated in more toilet tanks as toilet tanks are generally more wide than deep. Although a circular and elliptical siphon flush valve are described, a siphon flush valve may be other shapes.

Although siphon flush valves of the present disclosure are depicted and described as substantially concentrically arranged siphon flush valves, other shapes and arrangements are possible. A substantially concentric siphon flush valve may allow for uniform flow from the tank into a siphon flush valve. Uniform flow may improve the efficiency and rate of flow in a siphon flush valve. Other contemplated shapes and arrangements (e.g. non-concentric arrangements) may also exhibit uniform flow from the tank into a siphon flush valve.

A toilet system may include a control assembly. A control assembly may be coupled to a toilet tank. A control assembly may be coupled to an exterior of the toilet tank. A control assembly may be coupled to an interior of the toilet tank within a water proof compartment or container. A control assembly may include one or more of a sensor, a battery, wiring, or a printed circuit board controller (controller). A sensor may be an infrared sensor (IR sensor) for detecting the presence and/or absence of a user at toilet. A control assembly may be associated with solenoid valve. Alternatively, a sensor may be omitted and a system may be actuated by manual flush handle or button actuator. A solenoid valve is controllable between an open position and a closed position. In an open position, a valve may admit fluid from a first siphon flush valve supply line to a second siphon flush valve supply line. A second siphon flush valve supply line may be the same as a siphon flush valve fluid supply line previously described. A second siphon flush valve supply line may supply water to an initiator. In a closed position, a valve may prevent flow between a second siphon flush valve supply line and a first siphon flush valve supply line. Alternatively, a solenoid may be replaced with a metering valve or hydro-mechanical valve. Hydro-mechanical and/or metering valves may use line pressure and/or springs to temporarily open the valve. A printed circuit board may send and receive signals from sensor to and from a solenoid. A battery may be a battery pack and may supply power to the various electric components. A control assembly may be mounted on a mounting board.

A tee may allow a water source for an initiator to be tapped prior to a fill valve. A pressure for an initiator may be determined by a building infrastructure, typically between about 20 psi and about 120 psi. A lower pressure may equate to a lower spray volume and lower pressure generation in a siphon flush valve, thus resulting in a lower efficiency siphon flush valve. Initiators of the present disclose may form a pattern, annular in form, from the center of an initiator head diverging toward and making contact with the bore of the core.

In some embodiments, a present system may comprise a vacuum breaker, which may be required to allow a flush valve to be code compliant. A vacuum breaker may be positioned upstream (prior to) a spray initiator.

Divergent spray angles ranging from about 50 degrees to about 120 degrees may be provided. A spray pattern may be solid or hollow in form and may be cone, square, pyramid, or oval, etc. in shape. Initiators may be singular or plurality part construction. An initiator may be fixed permanently or made for ease of removal for maintenance. An initiator may be fixed by overmolding, glue, interference fit, screw, or bayonet thread. In some embodiments, a connection between an initiator and a siphon flush valve head may be sealed, e.g., leak-free.

Siphon flush valves of the present disclosure allow for a flapperless flush system. Siphon flush valves of the present disclosure allow for a system which does not leak due to worn, chemically degraded, damaged, etc. flapper seals. Siphon flush valves of the present disclosure allow for a flush valve with no moving parts, reducing the likelihood of damage, failure, and/or need for repair. A concentric design of the head with respect to the core allows for higher flow throughput in a compact structure.

Siphon flush valves of the present disclosure may be combined with a bidet. Siphon flush valves of the present disclosure may work with one-piece and two-piece toilets having a water tank reservoir. For a one-piece toilet, a siphon flush valve may have a base fixation type that may differ from the two-piece toilet (e.g. the threaded spud with nut). Siphon flush valves of the present disclose may be provided to a toilet having a remote tank or cistern. For example, a tank or cistern hidden in a wall. In this example, additional water conduits may be needed.

A toilet bowl comprises a rim extending at least partially around an upper perimeter of the bowl, an interior surface, and a sump area. In some embodiments, a rim may define a rim channel extending from a rim inlet port and around an upper perimeter of the bowl and having at least one rim outlet port in fluid communication with an interior surface of the bowl. Fluid flow through a rim channel may serve to clean the bowl. In an embodiment, a bowl may have a rim shelf extending transversely along an interior surface of the bowl from a rim inlet port at least partially around the bowl so that fluid is configured to travel along the rim shelf and enter the bowl interior in at least one location displaced from the rim inlet port.

A bowl sump area is in fluid communication with a trapway inlet. A bowl sump area may define a sump trap. In some embodiments, a portion of an interior wall of the bowl in the sump area may be configured to upwardly incline from a jet outlet port toward the trapway inlet.

The sump area of the bowl in one embodiment has a sump trap defined by the interior surface of the bowl and having an inlet end and an outlet end, wherein the inlet end of the sump trap receives fluid from the jet outlet port and/or the interior area of the bowl and the outlet end of the sump trap is in fluid communication with the trapway inlet; and wherein the sump trap has a seal depth. An upper surface or uppermost point of the jet outlet port may be within the sump trap and positioned at a seal depth below an upper surface of the inlet to the trapway as measured longitudinally through the sump area. In some embodiments, a sump trap seal depth may be from any of about 1 cm, about 2 cm, about 3 cm, about 4 cm or about 5 cm to any of about 6 cm, about 7 cm, about 8 cm, about 9 cm, about 10 cm, about 11 cm, about 12 cm, about 13 cm, about 14 cm or about 15 cm or more.

In some embodiments, a toilet assembly may comprise a jet defining at least one jet channel, the jet channel extending from a jet inlet port in fluid communication with a flush valve to a jet outlet port positioned in a bowl sump area and configured for discharging fluid through the sump area to a trapway. In some embodiments, a jet channel, once primed with fluid, is capable of remaining primed before actuation of and after completion of a flush cycle.

A trapway is in fluid communication with a sump area of a toilet bowl and with a waste outflow line. In some embodiments, a trapway may have a shape defining a first upstream weir and a second downstream weir. A trapway may comprise a sump trap, the sump trap providing a bowl water spot. A trapway may also comprise a lower trap positioned downstream of a sump trap. A first upstream weir may be positioned in a trapway portion defined from a downstream water level of a sump trap to an upstream water level of a lower trap (between the sump trap and lower trap). In some embodiments, a conduit may be coupled to a trapway portion between the sump trap and lower trap. In some embodiments, a conduit may be coupled to a trapway at or near a first weir.

In some embodiments, a conduit portion coupled to a trapway may be integrally formed in chinaware, and may be configured to couple to a conduit portion of a flush valve assembly. In other embodiments, a conduit portion coupled to a trapway may comprise a thermoplastic. In some embodiments, a conduit running from a flush valve assembly to a trapway may be a unitary structure, or may comprise two or more separate segments coupled together. A conduit in total includes conduit portions from an upper end to a connection point at a trapway.

A flush valve assembly may comprise a siphon flush valve assembly and a container. A container may generally be defined by a continuous side wall and top wall (upper end). A continuous wall may comprise side walls of a rectangular-shaped box-like structure, a cylinder-like structure, or an irregular structure as shown in the figures. In some embodiments, an upper end may comprise a cylinder-shaped opening to receive a siphon flush valve. A container opening may generally be centered, or may be off-center. A container opening may comprise a continuous wall, which wall may extend downward to about a same point as a container wall lower edge, or, alternatively, to a lower or higher point than a container wall lower edge. In some embodiments, a container may comprise 2 or more legs. Legs may be configured to allow vertical adjustment of a container.

In some embodiments, a container may have other shapes, for example a pyramid-like shape, a sphere- or spheroidal-like shape, an ovoid shape, a cone shape, an ellipsoid-like shape, partial shapes thereof, and the like.

In some embodiments, a flush valve assembly comprises a container having an open lower end and a closed upper end. In some embodiments, an open lower end may mean an entire lower end is open, in other embodiments, an open lower end may mean a lower end may comprise one or more openings. A conduit portion may be positioned at an interior of the container. A conduit runs from the container interior to a trapway, and provides flow communication between the container interior and the trapway. In some embodiments, a container may have one or more openings positioned in a container wall. In some embodiments, a container may have one or more openings positioned towards a lower end thereof. In some embodiments, a container may have a plurality of openings positioned at or near a lower end thereof.

In a pre-flush condition (between flush cycles), a toilet tank water level may be positioned at, near, or below a top of a flush valve head and above a flush valve inlet; and also at, near, or below a top upper edge of a container and above a container lower edge. In various embodiments, a flush valve head upper surface may be positioned below, at or near, or above an upper edge of a container.

In some embodiments, a container may have a closed upper end. In a pre-flush condition, a container may contain a level of toilet tank water in a lower end and an air portion in an upper end. An upper end of a conduit may be positioned in the air portion. In some embodiments, a container may contain essentially no air between flush cycles, or just enough air to cover an upper end of a conduit.

A flush cycle is completed upon re-filling the toilet tank, a sump trap, and a lower trap. Upon completion of a flush cycle, new flush water entering the toilet tank also enters the container via an open lower end and/or one or more openings positioned in a container wall. Entry of water into the container may compress air into a container upper end, and may return an air volume defined by a container upper end, a conduit, and a trapway portion between a sump trap and a lower trap to atmospheric pressure or a positive pressure above atmospheric. In some embodiments, a positive air pressure above atmospheric may be from any of about 0.5 cm of water, about 0.8 cm of water, about 1.1 cm of water, about 1.4 cm of water, about 1.7 cm of water, about 2.0 cm of water, about 2.3 cm of water, about 2.6 cm of water, or about 2.9 cm of water, to any of about 3.2 cm of water, about 3.5 cm of water, about 3.8 cm of water, about 4.1 cm of water, about 4.4 cm of water, about 4.7 cm of water, about 5.0 cm of water, or more.

Upon initiation of a flush cycle, flush water is discharged from the toilet tank and the container through the siphon flush valve tubular core. This exerts a negative pressure on the air volume defined by the container upper end, conduit, and trapway portion between a sump trap and a lower trap. The negative pressure may mean a drop to atmospheric pressure or a partial vacuum. The negative pressure helps create a siphon to pull water and waste through the sump area and into and out of the trapway.

In some embodiments, a conduit may comprise a back-flow preventer to prevent waste water from entering the conduit.

A container may comprise an open lower end and/or one or more openings positioned in a container wall, configured to provide fluid communication between a container interior space and a toilet tank. In some embodiments, a container may comprise one or more openings positioned towards a lower end thereof.

In some embodiments, a toilet assembly is configured so that an inadvertent loss of air pressure in an air volume between flush cycles is prevented.

In some embodiments, a toilet assembly may be configured for an operator to choose for instance a "full flush" of about 1.6 gallons (about 6 liters) of water to eliminate solid waste or a "partial flush" (short flush) of a lower volume or water, for example about 1.1 gallons (about 4 liters), for the removal of liquid waste. A choice of flush volume may depend on pressurized water valve open time.

Upon initiation of a flush cycle in a present apparatus, two separate, but related reduced-pressure (vacuum/partial-vacuum) conditions operate to initiate/aid a siphon flush. Injection of spray water from an initiator into a flush valve tubular core creates reduced-pressure in the core which initiates a siphon flush to direct tank water through the flush valve to a toilet bowl. This siphon may break when tank water drops to a level of a flush valve head inlet, introducing air and stopping the siphon. As tank water drops, reduced-pressure is created in an air volume defined by an upper portion of the container, the conduit, and a trapway portion between the sump trap and the lower trap. This separate reduced-pressure condition during a flush may aid a siphon flow through the trapway.

Following are some non-limiting embodiments of the disclosure.

In a first embodiment, disclosed is a toilet assembly, comprising a toilet tank to hold flush water; a flush valve assembly positioned in the toilet tank; a toilet bowl; and a trapway in flow communication with the toilet bowl, wherein, the flush valve assembly comprises a container having an open lower end and a closed upper end; a siphon flush valve positioned in the container upper end; and a conduit positioned in an interior of the container, wherein the container is in flow communication with the toilet tank, the conduit is coupled to the trapway and provides flow communication between the container and the trapway, and the siphon flush valve comprises a tubular core, a head surrounding a top of the core, and a fluid spray initiator coupled to the head, the spray initiator configured to discharge water into the core to induce a siphon flow of surrounding tank water through the core.

In a second embodiment, disclosed is a toilet assembly according to the first embodiment, wherein the trapway comprises a sump trap and a lower trap, and wherein the conduit is coupled to the trapway at a position between the sump trap and the lower trap.

In a third embodiment, disclosed is a toilet assembly according to embodiment 2, wherein, when between flush cycles, the toilet assembly comprises an air volume defined by an upper end of the container, the conduit, and a portion of the trapway between the sump trap and the lower trap. In a fourth embodiment, disclosed is a toilet assembly according to embodiment 3, wherein, when between flush cycles, the container contains a toilet tank water portion and an air portion.

In a fifth embodiment, disclosed is a toilet assembly according to embodiment 4, wherein an upper end of the conduit is configured to be positioned in the air portion. In a sixth embodiment, disclosed is a toilet assembly according to any of embodiments 3 to 5, wherein, upon discharging water into the flush valve core to initiate a flush cycle, reduced pressure is created in the air volume.

In a seventh embodiment, disclosed is a toilet assembly according to any of embodiments 3 to 6, wherein, upon a toilet tank water level falling to a lower edge of the flush valve head to break the siphon, and re-filling the toilet tank with water to end a flush cycle, increased pressure is created in the air volume. In an eighth embodiment, disclosed is a toilet assembly according to any of embodiments 3 to 7, wherein when between flush cycles, the air volume is under a positive pressure of from about 0.5 cm to about 5.0 cm of water above atmospheric pressure.

In a ninth embodiment, disclosed is a toilet assembly according to any of the preceding embodiments, wherein the container comprises a continuous side wall and a top, upper end wall. In a tenth embodiment, disclosed is a toilet assembly according to any of the preceding embodiments, wherein a container upper end comprises a substantially cylinder-shaped opening to receive the siphon flush valve, the container opening comprising a continuous wall extending downward from the container upper end.

In an eleventh embodiment, disclosed is a toilet assembly according to any of the preceding embodiments, wherein the container comprises an irregular box-like shape. In a twelfth embodiment, disclosed is a toilet assembly according to any of the preceding embodiments, wherein the conduit comprises a backflow preventer.

In a thirteenth embodiment, disclosed is a flush valve assembly comprising a container having an open lower end and a closed upper end; a siphon flush valve positioned in the container upper end; and a conduit positioned in an interior of the container, wherein the container is configured to be in flow communication with a toilet tank, the siphon flush valve comprises a tubular core, a head surrounding a top of the core, and a fluid spray initiator coupled to the head, the spray initiator configured to discharge water into the core to induce a siphon flow of surrounding toilet tank water through the core, and the conduit is configured to couple to a toilet trapway and to provide flow communication between the container and the trapway.

In a fourteenth embodiment, disclosed is a flush valve assembly according to embodiment 13, wherein a lower end of the flush valve head defines a siphon valve inlet, a lower end of the tubular core defines a siphon valve outlet, an upper end of the tubular core defines a weir, and wherein the spray initiator is configured to discharge water into the core to induce a siphon flow of surrounding toilet tank water through the siphon valve inlet, over the weir, through the core, and out the siphon valve outlet.

In a fifteenth embodiment, disclosed is a flush valve assembly according to embodiments 13 or 14, wherein the head comprises a substantially cylindrical cap located about the core. In a sixteenth embodiment, disclosed is a flush valve assembly according to any of embodiments 13 to 15, wherein the spray initiator is positioned towards a center of the head and extends downward through an opening in the head into the tubular core.

In a seventeenth embodiment, disclosed is a flush valve assembly according to any of embodiments 14 to 16, wherein the siphon valve inlet is located substantially circumferentially around the core. In an eighteenth embodiment, disclosed is a flush valve assembly according to any of embodiments 14 to 17, wherein the spray initiator is configured to discharge pressurized water into the core.

In a nineteenth embodiment, disclosed is a flush valve assembly according to any of embodiments 13 to 18, wherein the spray initiator comprises a tapered bore. In a twentieth embodiment, disclosed is a flush valve assembly according to any of embodiments 13 to 19, wherein the spray initiator is configured to discharge water in a full cone-shaped spray, hollow cone-shaped spray, square cone-shaped spray, or pyramid-shaped spray.

In a twenty-first embodiment, disclosed is a flush valve assembly according to any of embodiments 13 to 20, wherein the assembly comprises no moving parts. In a twenty-second embodiment, disclosed is a flush valve assembly according to any of embodiments 13 to 21, wherein the spray initiator is coupled to a fluid supply line. In a twenty-third embodiment, disclosed is a flush valve assembly according to any of embodiments 13 to 22, wherein the spray initiator is coupled to a fluid supply valve.

In a twenty-fourth embodiment, disclosed is a flush valve assembly according to any of embodiments 13 to 23, wherein the spray initiator is coupled to a solenoid valve. In a twenty-fifth embodiment, disclosed is a flush valve assembly according to any of embodiments 13 to 24, comprising an actuator configured to open a fluid supply valve to initiate water flow into the core.

In a twenty-sixth embodiment, disclosed is a flush valve assembly of any of embodiments 13 to 25, comprising an actuator configured to open a fluid supply valve to initiate water flow into the core and to close the fluid supply valve after a predetermined time interval. In a twenty-seventh embodiment, disclosed is a flush valve assembly of any of embodiments 13 to 26, wherein water discharge is configured to create a pressure differential between a bore of the core and the surrounding fluid.

In a twenty-eighth embodiment, disclosed is a flush valve assembly according to any of embodiments 13 to 27, wherein the container comprises a continuous side wall and a top, upper end wall. In a twenty-ninth embodiment, disclosed is a flush valve assembly according to any of embodiments 13 to 28, wherein a container upper end comprises a substantially cylinder-shaped opening to receive the siphon flush valve, the container opening comprising a continuous wall extending downward from the container upper end.

In a thirtieth embodiment, disclosed is a toilet tank assembly, comprising the flush valve assembly according to any of embodiments 13 to 29 positioned in a toilet tank.

The term "adjacent" may mean "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through and may be synonymous with "fluidly coupled". The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A toilet assembly, comprising
a toilet tank to hold flush water;
a flush valve assembly positioned in the toilet tank;
a toilet bowl; and
a trapway in flow communication with the toilet bowl,
wherein, the flush valve assembly comprises
a container having an open lower end and a closed upper end;
a siphon flush valve positioned in the container upper end; and
a conduit positioned in an interior of the container,
wherein
the container is in flow communication with the toilet tank,
the conduit is coupled to the trapway and provides flow communication between the container and the trapway,
the siphon flush valve comprises a tubular core, a head surrounding a top of the core, and a fluid spray initiator coupled to the head, the spray initiator configured to discharge water into the core to induce a siphon flow of surrounding tank water through the core,
the trapway comprises a sump trap and a lower trap, and wherein the conduit is coupled to the trapway at a position between the sump trap and the lower trap, and
when between flush cycles, the toilet assembly comprises an air volume defined by an upper end of the container, the conduit, and a portion of the trapway between the sump trap and the lower trap.

2. The toilet assembly according to claim 1, wherein, when between flush cycles, the container contains a toilet tank water portion and an air portion, and wherein an upper end of the conduit is configured to be positioned in the air portion.

3. The toilet assembly according to claim 1, wherein, upon discharging water into the flush valve core to initiate a flush cycle, reduced pressure is created in the air volume.

4. The toilet assembly according to claim 1, wherein, upon a toilet tank water level falling to a lower edge of the flush valve head to break the siphon, and re-filling the toilet tank with water to end a flush cycle, increased pressure is created in the air volume.

5. The toilet assembly according to claim 1, wherein when between flush cycles, the air volume is under a positive pressure of from about 0.5 cm to about 5.0 cm of water above atmospheric pressure.

6. The toilet assembly according to claim 1, wherein the container comprises a continuous side wall and a top, upper end wall, and wherein a container upper end comprises an opening to receive the siphon flush valve, the container opening comprising a continuous wall extending downward from the container upper end.

7. A flush valve assembly comprising
a container having an open lower end and a closed upper end;
a siphon flush valve positioned in the container upper end; and
a conduit positioned in an interior of the container,
wherein
the container is configured to be in flow communication with a toilet tank,
the siphon flush valve comprises a tubular core, a head surrounding a top of the core, and a fluid spray initiator coupled to the head, the spray initiator configured to discharge water into the core to induce a siphon flow of surrounding toilet tank water through the core, and
the conduit is configured to couple to a toilet trapway and to provide flow communication between the container and the trapway.

8. The flush valve assembly according to claim 7, wherein a lower end of the flush valve head defines a siphon valve inlet, a lower end of the tubular core defines a siphon valve outlet, an upper end of the tubular core defines a weir, and wherein the spray initiator is configured to discharge water into the core to induce a siphon flow of surrounding toilet tank water through the siphon valve inlet, over the weir, through the core, and out the siphon valve outlet.

9. The flush valve assembly according to claim 7, wherein the head comprises a substantially cylindrical cap located about the core, and wherein the siphon valve inlet is located substantially circumferentially about the core.

10. The flush valve assembly according to claim 7, wherein the spray initiator is positioned towards a center of the head and extends downward through an opening in the head into the tubular core.

11. The flush valve assembly according to claim 7, wherein the spray initiator is configured to discharge pressurized water into the core.

12. The flush valve assembly according to claim 7, wherein the spray initiator comprises a tapered bore.

13. The flush valve assembly according to claim 7, wherein the spray initiator is configured to discharge water in a full cone-shaped spray, hollow cone-shaped spray, square cone-shaped spray, or pyramid-shaped spray.

14. The flush valve assembly according to claim 7, wherein the assembly comprises no moving parts.

15. The flush valve assembly according to 7, wherein the spray initiator is configured to couple to a fluid supply line and a fluid supply valve.

16. The flush valve assembly according to 7, wherein the spray initiator is configured to couple to a solenoid valve.

17. The flush valve assembly according to claim 7, comprising an actuator configured to open a fluid supply valve to initiate water flow into the core.

18. The flush valve assembly of claim 7, comprising an actuator configured to open a fluid supply valve to initiate water flow into the core and to close the fluid supply valve after a predetermined time interval.

19. The flush valve assembly of claim 7, wherein water discharge is configured to create a pressure differential between a bore of the core and the surrounding fluid.

20. The flush valve assembly according to claim 7, wherein the container comprises a continuous side wall and a top, upper end wall, and an opening to receive the siphon flush valve, the container opening comprising a continuous wall extending downward from the container upper end.

* * * * *